US009199652B1

(12) United States Patent
Brook et al.

(10) Patent No.: US 9,199,652 B1
(45) Date of Patent: Dec. 1, 2015

(54) LIGHTWEIGHT, FATIGUE RESISTANT KNUCKLE

(71) Applicant: Pennsy Corporation, West Chester, PA (US)

(72) Inventors: Zachary Brook, Leola, PA (US); Manuel Tavares, Doylestown, PA (US); Michael J. Schmidt, Norristown, PA (US)

(73) Assignee: PENNSY CORPORATION, West Chester, PA (US)

( * ) Notice: Subject to any disclaimer, the term of this patent is extended or adjusted under 35 U.S.C. 154(b) by 71 days.

(21) Appl. No.: 13/842,229

(22) Filed: Mar. 15, 2013

Related U.S. Application Data

(63) Continuation-in-part of application No. 13/678,021, filed on Nov. 15, 2012.

(51) Int. Cl.
*B61G 3/10* (2006.01)
*B61G 3/04* (2006.01)

(52) U.S. Cl.
CPC ..... *B61G 3/04* (2013.01)

(58) Field of Classification Search
USPC ..... 213/75 R, 77, 78, 100 R, 109–111, 213/151–156
See application file for complete search history.

(56) References Cited

U.S. PATENT DOCUMENTS

| | | | |
|---|---|---|---|
| 461,312 | A | 10/1891 | Brown |
| 533,985 | A | 2/1895 | Brown |
| 693,998 | A | 2/1902 | Brown |
| 2,088,135 | A | 7/1937 | Johnson et al. |
| 2,562,504 | A | 7/1951 | Metzger |
| 2,688,412 | A | 9/1954 | Kulieke |
| 2,689,051 | A | 9/1954 | Kayler |
| 3,670,901 | A | 6/1972 | Metzger |
| 3,722,708 | A | 3/1973 | Ion et al. |
| 3,779,397 | A | 12/1973 | De Penti |
| 3,853,228 | A | 12/1974 | Metzger |
| 3,856,156 | A | 12/1974 | Metzger |
| 4,090,615 | A | 5/1978 | Martin |
| 4,206,849 | A | 6/1980 | Kaim |
| 4,605,133 | A | 8/1986 | Altherr |
| 4,645,085 | A | 2/1987 | Hanula et al. |
| 5,562,045 | A | 10/1996 | Rudibaugh et al. |
| 5,582,307 | A | 12/1996 | Hawthorne et al. |
| 5,799,582 | A | 9/1998 | Rudibaugh et al. |

(Continued)

OTHER PUBLICATIONS

Brandenberg, Kristin; "Successfully Machining Austempered Ductile Iron (ADI)"; Applied Process Inc. Technologies Div.—Livonia, Michigan, USA; Oct. 2001.

(Continued)

*Primary Examiner* — R. J. McCarry, Jr.
(74) *Attorney, Agent, or Firm* — John F. A. Early, III; Frank J. Bonini, Jr.; Harding, Earley, Follmer & Frailey, P.C.

(57) ABSTRACT

A railway vehicle coupler knuckle for coupling a rail car, the knuckle being constructed having an improved configuration to provide a lightweight knuckle that has the same, and preferably improved, strength and resistance to fatigue as prior knuckles of greater weight, or being constructed from material and/or combinations of configurations and materials that facilitate a stronger and more fatigue resistant construction, a lightweight construction, or combinations of these properties.

35 Claims, 15 Drawing Sheets

(56) References Cited

U.S. PATENT DOCUMENTS

| | | | | |
|---|---|---|---|---|
| 5,878,548 | A | 3/1999 | Sauer et al. | |
| 5,878,897 | A * | 3/1999 | Lazzaro et al. | 213/139 |
| 5,900,082 | A | 5/1999 | Hewitt | |
| 5,943,961 | A | 8/1999 | Rudibaugh et al. | |
| 5,954,212 | A * | 9/1999 | Beatty et al. | 213/155 |
| 6,129,227 | A | 10/2000 | Openchowski et al. | |
| 6,796,448 | B1 | 9/2004 | Wilt et al. | |
| 7,302,826 | B2 | 12/2007 | Yoon | |
| 7,302,994 | B2 | 12/2007 | Mautino et al. | |
| 7,337,826 | B2 | 3/2008 | Mautino et al. | |
| D620,839 | S | 8/2010 | Smyth | |
| 8,196,762 | B2 | 6/2012 | Smerecky | |
| 8,201,613 | B2 | 6/2012 | Marchese et al. | |
| 8,297,455 | B2 | 10/2012 | Smyth | |
| 8,302,790 | B2 | 11/2012 | Dumey | |
| 8,381,923 | B2 | 2/2013 | Smyth | |
| 8,485,371 | B2 | 7/2013 | Mibouar et al. | |
| 8,499,819 | B2 | 8/2013 | Nibouar et al. | |
| 8,631,952 | B2 | 1/2014 | Smerecky | |
| 8,646,631 | B2 | 2/2014 | Marchese et al. | |
| 8,662,327 | B2 * | 3/2014 | Nibouar et al. | 213/75 R |
| 2009/0289024 | A1 | 11/2009 | Nibouar et al. | |
| 2011/0068077 | A1 | 3/2011 | Smyth | |
| 2012/0037586 | A1 | 2/2012 | Dumey | |
| 2012/0217217 | A1 | 8/2012 | Smerecky | |
| 2013/0160962 | A1 | 6/2013 | Nibouar et al. | |

OTHER PUBLICATIONS

A. Kahn and B.K. Chen, "Evaluation of Grade 1 Austempered Ductile Iron for Application to Rail Cast Components", Proceedings of the Fifth Asia Pacific Industrial Engineering and Management Systems Conference 2004.

Luís Magalhães, Jorge Seabra, "Teeth Surface Failures in Austempered Ductile Iron (ADI) Gears", Gears and Transmission Workshop, Paper No. XIII, p. 269-286, Faculdade de Engenharia da Universidade do Porto, Portugal, 5th, Jun. 2003.

Stokes B. et al.; "Effects of Carbides on Fatigue Characteristics of Austempered Ductile Iron", Metallurgical and Materials Transactions A, 36 (2005) 977-988.

Bubenko et al.; "Fatigue Crack Propagation through Austempered Ductile Iron Microstructure"; Materials Engineering, vol. 17, 2010, No. 3, p. 15-20.

Bubenko et al.; "Fatigue Crack Propagation Within the Austempered Ductile Iron Microstructure"; Acta Metallurgica Slovaca, vol. 17, 2011, No. 1, p. 18-25.

Dundar, Sacit; "Application of Austempered Ductile Iron to Rail Wheel Sets"; Journal of Engineering Sciences 2003, 9 (3), p. 283-287.

International ADI and Simulation Conference; May 28-30, 1997.

Knuckles, Types E and F—Fatigue Test, AAR Manual of Standards and Recommended Practices Castings, 2009, S [M-216] 343- S [M-216] 346.

Keough J. R., et al.; "Continuing Developments in the Science and Application of Austempered Ductile Iron (ADI)"; 2012.

AAR Manual of Standards and Recommended Practices Casting Details; Castings, Steel; Specification M-201; S [M-201] 41-S [M-201] 49.

AAR Manual of Standards and Recommended Practices Casting Details; S [M-211] 143-S [M-211] 149.

AAR Manual of Standards and Recommended Practices Casting Details; Coupling Systems; Specification M-215; S [M-215] 337-S [M-215] 342.

"The Six Standard ADI Grades Per ASTM A897/A897M-06"; www.appliedprocess.com; Issued Nov. 4, 2008.

* cited by examiner

LIGHTWEIGHT, FATIGUE RESISTANT KNUCKLE

CROSS-REFERENCE TO RELATED APPLICATIONS

This application is a continuation-in-part of U.S. application Ser. No. 13/678,021, filed: Nov. 15, 2012, the complete contents of which are herein incorporated by reference.

BACKGROUND OF THE INVENTION

1. Field of Invention

The present invention relates generally to the field of railroad couplers, and more specifically to American Association of Railroads ("AAR") Standard E and F type railroad car couplers, especially to the knuckles used in these couplers. More particularly, the invention relates to a lightweight knuckle that is suitably strong while also still allowing the knuckle to be the weak point of the coupler. In addition the invention relates to reducing the weight of the knuckle while maintaining and/or improving the fatigue resistance of the knuckle.

2. Brief Description of the Related Art

Railcar couplers are disposed at each end of a railway car to enable joining one end of such railway car to an adjacently disposed end of another railway car. The engageable portions of each of these couplers are known in the railway art as a knuckle. For example, railway freight car coupler knuckles are disclosed in numerous U.S. patents, such as, for example, including in the following U.S. patent documents: U.S. Pat. Nos. 461,312; 533,985; 693,998; 2,689,051; 4,024,958; 4,206,849; 4,605,133; 5,582,307 and U.S. patent application no. 2009/0289024. In addition, lightweight railway freight car coupler knuckles are disclosed in U.S. Pat. Nos. 5,954,212 and 6,129,227.

Coupler knuckles are generally manufactured from cast steel weighing approximately 84 lbs. The cast steel used is grade E, tensile strength 120,000 psi, yield strength of 100,000 psi, elongation of 14%, reduction of area 30%. These knuckles fatigue crack over time which eventually leads to knuckle failure.

Knuckle failure accounts for about 100,000 train separations a year, or about 275 separations per day. Most of these separations occur when the train is out of a maintenance area. In such cases, a replacement knuckle, which can weigh about 80 pounds, must be carried from the locomotive at least some of the length of the train, which may be up to 25, 50 or even 100 railroad cars in length. The repair of a failed coupler knuckle can be labor intensive, can sometimes take place in very inclement weather, can cause train delays and is a two-man job because of the suggested 50 lbs per person lifting limits.

The front core of a knuckle is commonly referred to as the finger core. The finger core is commonly constructed to produce an internal cavity having thin ribs. These ribs made out of the standard grade E cast steel have demonstrated a weakness to the load environment with the development of fatigue and/or hot tear cracks. The fatigue cracks can grow over time and eventually lead to knuckle failure which results in separation of railcars. Separately, internal or external cracks in the knuckle are a cause for replacement of the knuckle.

The rear core of a knuckle is commonly referred to as the kidney core. Knuckles can sometimes break within this portion of the knuckle and this has proven to be a very undesirable location for a failure. A failure in this region of the knuckle can lead to knuckle jamming within the coupler body and prevent a change out of a failed knuckle, thereby requiring the entire coupler assembly to be replaced, a very costly repair.

There is a need for a knuckle with improved strength or fatigue life while still allowing it to be the weak link in the coupler system and fail under high loading conditions.

Further, there is a need for a lighter weight knuckle with similar strength or fatigue life while still allowing it to be the weak link in the coupler system and fail under high loading conditions.

In addition, there is a need for a lightweight knuckle, under 50 lbs, with strength or fatigue life similar to knuckles weighing more than 50 lbs, while still allowing the lightweight knuckle to be the weak link in the coupler system and fail under high loading conditions.

Additionally, there is a need for a lightweight knuckle, under 50 lbs, with improved fatigue life and similar strength to knuckles weighing more than 50 lbs while still allowing it to be the weak link in the coupler system and fail under high loading conditions.

SUMMARY OF INVENTION

The invention is designed to alleviate these problems, such as fatigue and breakage, by the provision of a substantially lighter weight knuckle which is strong enough to meet all the AAR standards for a full service rating. According to one embodiment, the invention provides a knuckle that weighs only about 48 pounds, but has significant strength as previous knuckles weighing much more than that.

In addition, another object of the invention to produce a knuckle that is substantially identical on the outside so it will look, function and/or operate the same as an AAR Standard knuckle in relation to the other components of the coupler and those of an opposing coupler during, for example, the coupling and uncoupling operations. For example, where the present coupler knuckle has been installed or implemented on one railroad vehicle, and another vehicle has a prior coupler (and/or coupler knuckle), preferred embodiments of the invention are constructed so the coupler knuckle may be compatible with other couplers (and/or knuckles) using AAR standards, regardless of the weight of the other couplers (and/or knuckles).

It is a further object of the invention to accomplish the above objects by providing a knuckle which may have an appearance that is substantially the same on the outside in that the knuckle may be constructed having exterior geometries that are substantially the same or similar to existing heavier knuckles, but with the knuckle being lighter in weight. Preferred embodiments maintain the AAR standards for knuckle couplers so that the knuckle couplers may be interconnected with other, prior knuckle couplers that also adhere to the AAR standards, including other knuckle couplers that weigh more or substantially more than couplers configured with the preferred lightweight knuckle embodiments of the present invention.

According to one embodiment, the invention accomplishes the above objects by providing an interior geometric configuration that is designed to provide sufficient strength while at the same time minimizing the material utilization.

According to some embodiments, the knuckle of the invention may have interior coring and/or rib arrangements beneath the outer wall or exterior surface, so that the knuckle geometry may appear, on the outside, to be similar or identical to prior, traditional knuckles, and may be used in conjunction with prior, traditional knuckles, so that the current, lightweight knuckles, constructed according to the invention, may be interchangeable with, and usable with, the traditional prior knuckles, including those prior knuckles that weigh more or substantially more than the preferred lightweight knuckles of the present invention. In addition to the coring and/or rib arrangements, knuckles, according to embodiments of the present invention, preferably, may be further improved through, reduction in weight, increases in tensile strength, or any combinations of these features, by constructing the knuckle from an austempered metal, such as, for example, austempered ductile iron, austempered steel, as well as other austempered metals and austempered metal alloys.

This lightweight knuckle is provided to be compatible with substantially all conventional knuckle type railroad couplers. Moreover, the other conventional components of the coupler, such as locks, throwers, and the AAR Standard mating knuckles, do not need modification, are fully compatible with this lightweight knuckle. According to preferred embodiments, industry standards as to form, fit, and function of a standard knuckle, such as 10A contour angling, coupling and gathering angles, lock drop and support and anti-creep functionality, are maintained and not compromised.

According to preferred embodiments, a fatigue-resistant knuckle is provided which is constructed from a material that is stronger and has improved resistance to fatigue than grade E cast steel. According to a preferred embodiment, a lightweight knuckle is provided which is constructed from a material that is stronger than grade E cast steel. It is a further object to accomplish the above objects by providing a knuckle that is constructed from a material that is at least as strong, or even stronger, than grade E cast steel but which is lighter in weight than grade E cast steel. It is another object of the invention to accomplish the above objects by providing an interior geometry that has one or more of coring and ribs, or combinations thereof and that also is constructed from a material that is lighter and of similar, or greater, strength than grade E cast steel.

It is an object of the invention to provide a knuckle coupler that is constructed from an austempered ductile metal. In a preferred embodiment, the austempered metal is austempered ductile iron (ADI). In another preferred embodiment the austempered metal is austempered steel, such as austempered alloy steel, and, according to other embodiments the knuckle may be constructed from an austempered metal alloy.

Austempered ductile iron (ADI) is produced by a suitable austempering process. For example, austempering of ductile iron may be accomplished by heat-treating cast ductile iron to which specific amounts of nickel, manganese, molybdenum, or copper, magnesium or combinations thereof have been added to improve hardenability; the quantities of the elements needed to produce the ADI from ductile iron are related to the knuckle configurations and, for example, may depend on the thickest cross-sectional area of the knuckle. Austempered steel and other austempered metals and austempered metal alloys, may be produced by any suitable austempering process.

According to one embodiment, it is another object of the invention to provide an improved fatigue-resistant knuckle that is of lighter weight than existing current knuckles, but without additional coring or modifications to the interior geometry, by constructing a knuckle from an ADI having a specific gravity of about 0.26 lbs/in^3, which is less than that of grade E cast steel, 0.283 lbs/in^3. According to one embodiment, a casting of the same shape will be lighter and stronger when constructed from ADI versus grade E cast steel. According to a preferred embodiment, there is a weight reduction of about 8% using the ADI as the preferred material for the knuckle versus using grade E cast steel.

Another benefit of the present invention is to provide a knuckle coupler and process for producing a knuckle coupler that provides economic benefits of conservation of materials, without sacrificing strength. For example, the utilization of a preferred ADI material improves handling efficiencies (as iron is easier to pour than steel), and improves material usage, as the ADI material increases in volume, slightly, as the metal knuckle casting cools compared to steel which shrinks. Accordingly, embodiments of the present invention provide a more efficient use of the materials, meaning less metal may be used to make the same final shape (for a knuckle having substantially the same or greater strength as if a greater amount of metal were used), as a way of reducing the knuckle weight.

In a second preferred embodiment, the austempered metal is austempered steel. Austempered steel is produced by a suitable austempering process. For example, austempering of steel may be accomplished by heat-treating cast steel to which specific amounts of chromium, magnesium, manganese, nickel, molybdenum, or copper, or combinations thereof, have been added to improve hardenability; the quantities of the elements needed to produce the austempered steel from the cast alloy steel are related to the knuckle configurations and, for example, may depend on the thickest cross-sectional area of the knuckle.

According to another embodiment, a lighter weight knuckle is constructed by selectively coring out material in thick load bearing areas to provide an alternate interior geometry for the knuckle.

According to preferred embodiments, the knuckle wall thickness is reduced, and the strength to weight ratio may remain the same as or greater than prior knuckles having thicker walls, and even being heavier in weight. The present knuckle also may improve payload to weight ratios, as a lightweight knuckle may allow for more weight to be cargo or other payload, especially where a locomotive is pulling a great number of cars that have knuckle couplers.

According to another embodiment, a knuckle coupler is provided having one or more zones of residual compressive stresses. According to one embodiment, a zone, or zones, of residual compressive stresses may be created on the entire inside and outside surface of any of the above embodiments of the lightweight knuckle, while according to alternate embodiments, zones of residual compressive stresses may be created only in areas that show high tensile stress when the part is used, or combinations thereof in the areas that show high tensile stresses. For example, according to a preferred embodiment, a knuckle coupler is provided with zones of residual compressive stresses in the main areas that exhibit high tensile stress during use, which preferably include the top and bottom pulling lugs, the tail, the pulling face and throat as well as the reinforcing ribs. According to one embodiment, a preferred method for creating residual compressive stresses is by shot peening. Shot peening involves impacting the surface with small spherical media projected at high speeds at the desired surfaces. According to embodiments of the invention, an engineered surface is provided, such as, for example, by subjecting the surface to a treatment process, such as, for example, shot peening, in order to provide the knuckle with an improved ability to counteract tensile stresses that are applied during use that would otherwise tend to cause crack initiation. The provisioning of the residual compressive stresses on the knuckle, such as, for example, using the shot peening procedure to impart impacts on the surfaces of the knuckle at one or more desired locations, increases fatigue life and performance without the need to increase the overall strength of materials or of the part.

BRIEF DESCRIPTION OF THE DRAWINGS

Knuckles according to the present invention are further described with reference to the following drawings and description of preferred embodiments, which are illustrative of the invention, and not limiting of the scope. The components in the figures are not necessarily to scale, emphasis instead being placed upon illustrating the principles of the invention. Moreover, in the figures, like-referenced numerals designate corresponding parts throughout the different views.

DETAILED DESCRIPTION OF THE PREFERRED EMBODIMENTS

Figure 1:
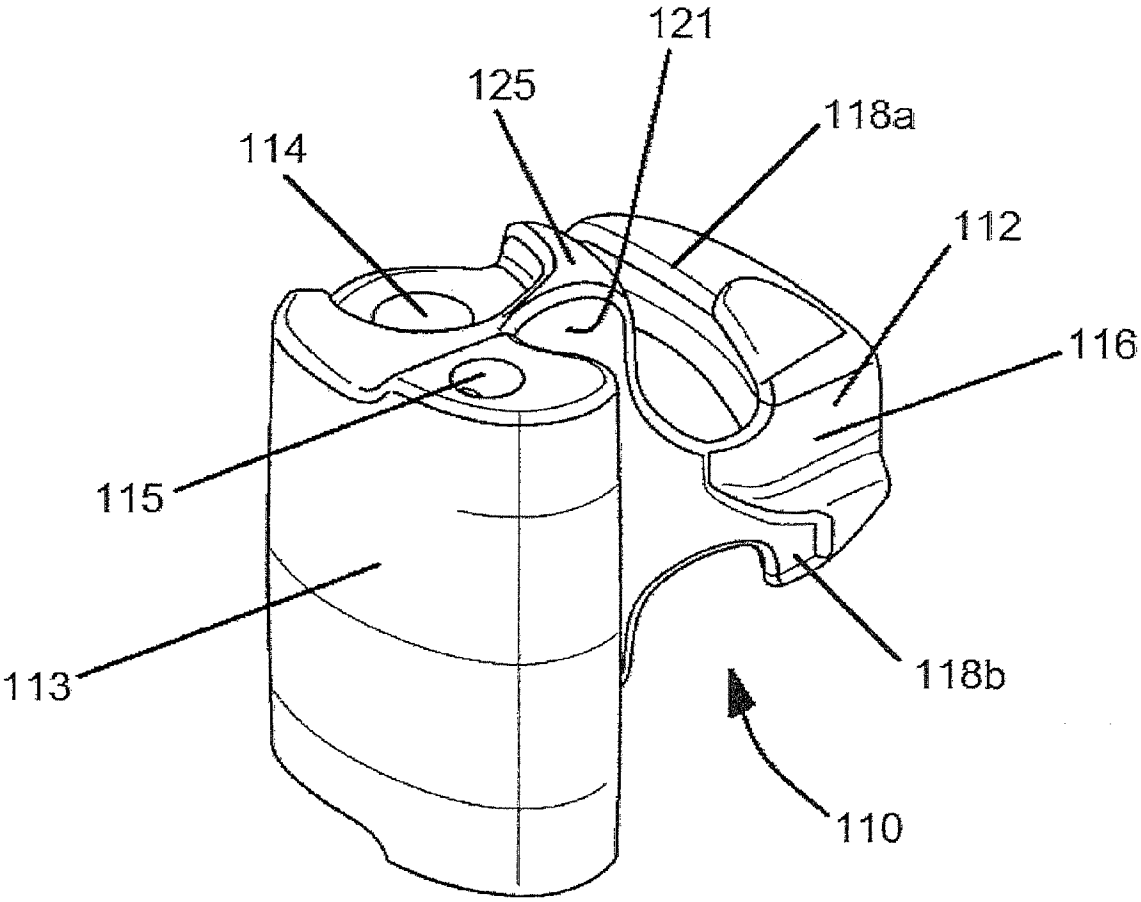
FIG. 1 is a perspective view of a knuckle constructed having prior exterior knuckle geometry, but illustrating a knuckle that is constructed with thinner walls, or from a lightweight material, or both.

The goal of the present invention is to improve the fatigue life of a knuckle. One way in which embodiments of the invention accomplish this is by providing coring that may include interior coring, external coring, or both. Another way in which embodiments of the invention accomplish this is by forming the knuckle from a material that is stronger than the cast grade E steel currently used. A further way in which embodiments of the invention accomplish this is by utilizing a material to construct the knuckle that is stronger and lighter than the cast grade E steel currently used. Other embodiments provide a lightweight knuckle by implementing both, a unique knuckle geometry and using a material that is lighter than the current cast steel and/or stronger than the current cast steel.

According to the embodiments illustrated, the knuckles 110, 210, 310, 410, 510, 610, 710 and 810, shown respectively in FIGS. 1-22, may be constructed having a suitable wall thicknesses to provide the knuckle with suitable strength to withstand force loads that the knuckle encounters during operations, including when in use on a railway vehicle. The knuckle, also referred to as a railway vehicle coupler knuckle, may be configured as a casting that includes a rear tail portion having a locking face, an intermediate section including a throat and pin hole, and a forward portion including a nose surface and a curved pulling face merging with the throat, and a forward surface substantially uniformly spaced from the pulling face along the full length of the knuckle. According to preferred embodiments, the casting may be made from an austempered metal, and preferably austempered steel, such as, austempered alloy steel. Other austempered metals, such as, for example, austempered ductile iron, and austempered metal alloys, may be used to construct the knuckle.

According to a preferred embodiment, the unique geometry includes providing one or more zones of reduced material, which, for example, according to one embodiment, may be accomplished by coring, and preferably, with specialized coring in designated zones of the knuckle.

According to preferred embodiments of the invention, a knuckle configuration is provided having areas of the knuckle that are reduced relative to other areas of the knuckle. The preferred geometries of the knuckle provide zones of size or weight reductions or both size and weight reduction, and where the size or weight reductions, or both, are employed to maximize the strength of the knuckle. According to a preferred embodiment, a knuckle is provided with reduced areas of size or weight, or, in some instances, elimination of structure in certain areas to provide a suitably strong knuckle that is able to withstand the stresses required for performance under operating loads.

According to a preferred embodiment, a lightweight knuckle may be substantially the same in appearance on the exterior to prior knuckle exterior appearances, yet the lightweight knuckle has a unique coring which is designed to provide adequate strength yet eliminate extraneous material. For example, the operative contour of the knuckle that is exhibited on the knuckle exterior may have an appearance similar to prior knuckles, but unlike prior knuckles, be configured with a different interior construction, where the interior geometry of the knuckle is configured and arranged in a manner that provides suitable performance strength with a reduced construction weight.

Figure 2:
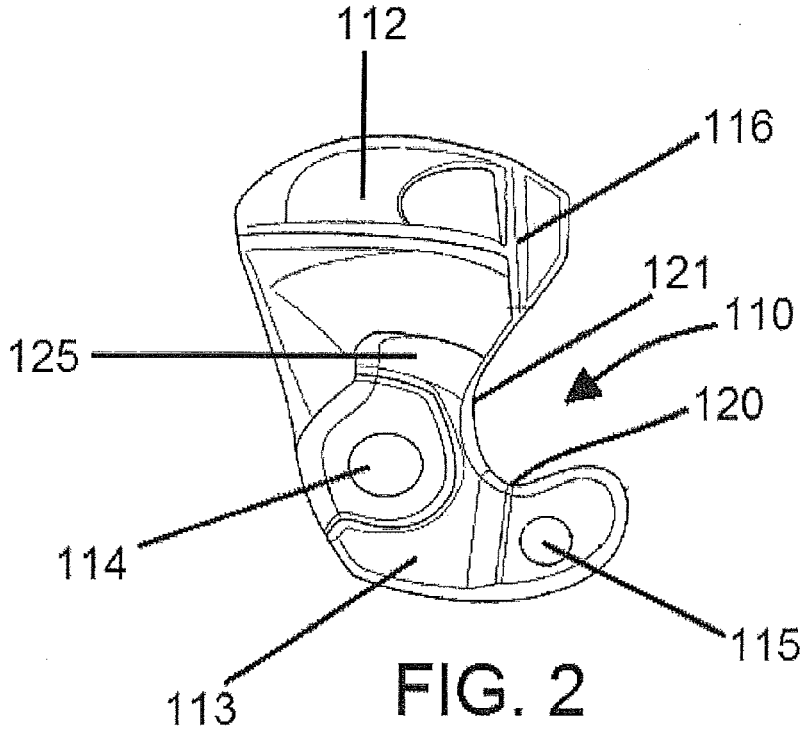
FIG. 2 is a top plan view of the knuckle of FIG. 1.
Figure 3:
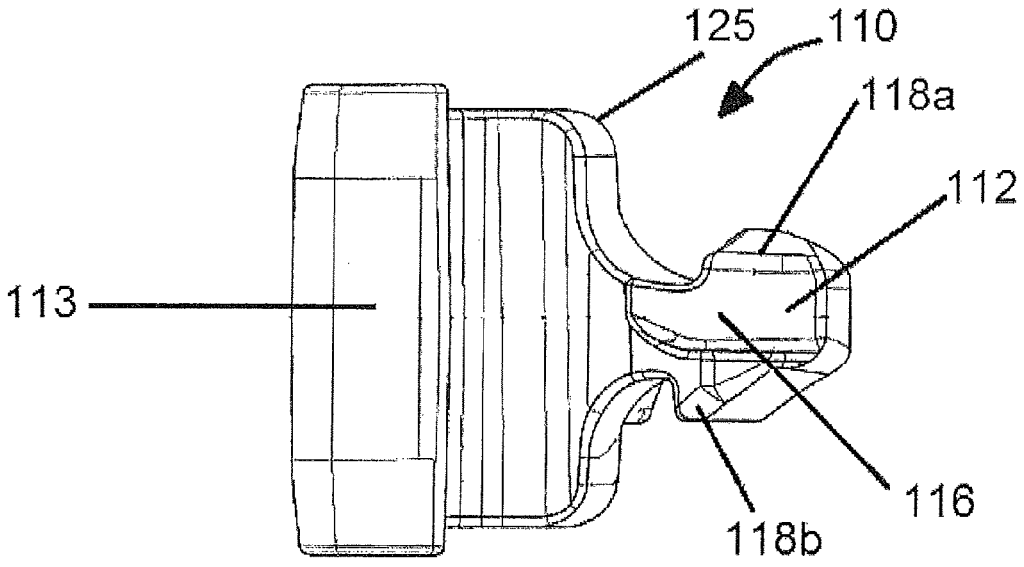
FIG. 3 is a right side elevation view of the knuckle of FIG. 1.

A knuckle 110 is shown in FIGS. 1-3, according to a preferred exemplary embodiment. The knuckle 110 is illustrated having a tail 112, a nose 113, a pin hole 114 and a finger core hole 115. The knuckle 110 preferably is shown having an exterior profile and configuration representative of an exemplary prior knuckle used in conjunction with coupling railway cars. The knuckle 110 is illustrated having pulling lugs 118*a* and 118*b* and a top hub 125, as best seen in FIGS. 1 and 3. The knuckle 110 also has a locking face 116, which is best viewed in FIG. 1. The knuckle 110 has a pulling face 120 (see FIG. 2) which is shown connected to a throat 121 by a curved surface.

Figure 4:
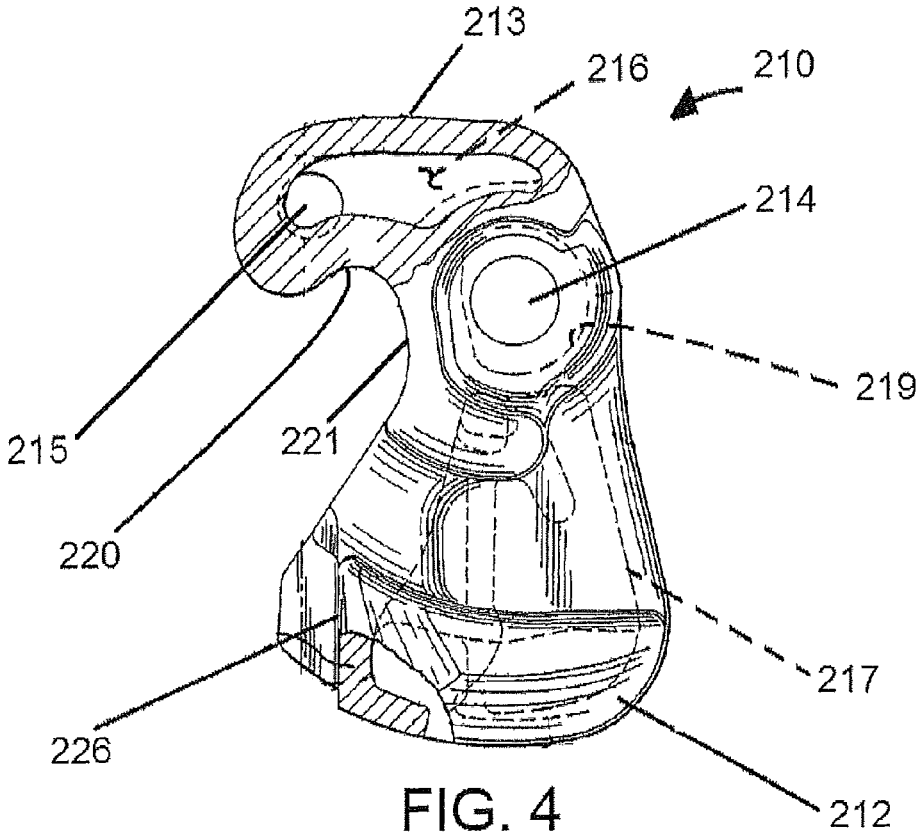
FIG. 4 is a top plan view of a knuckle configured according to the present invention having prior art finger, kidney and pin hole coring, showing views in the tail section and nose section that are cutaway views to show sections of the interior of the knuckle.
Figure 5:
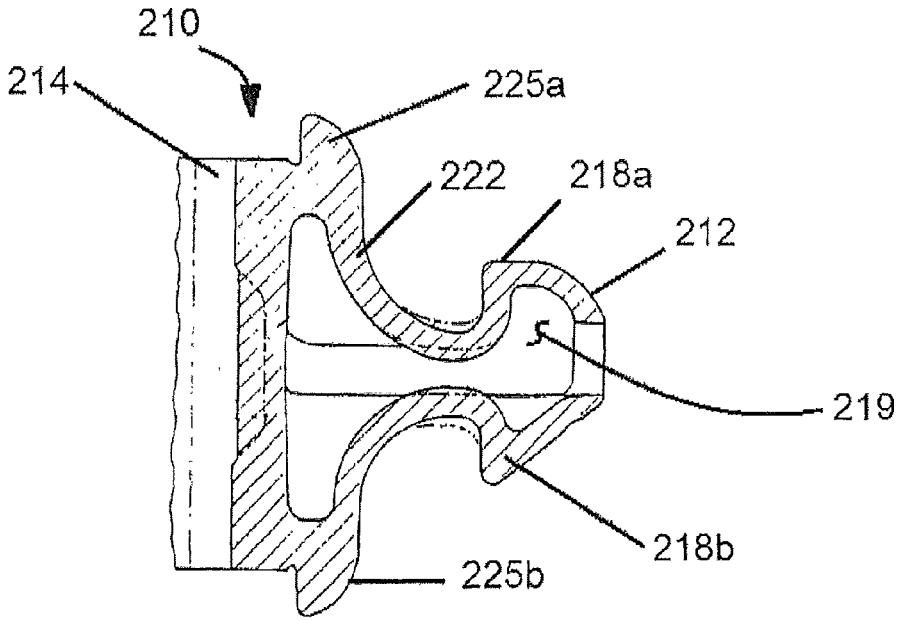
FIG. 5 is a right side sectional view of the knuckle of FIG. 4, viewed from the tail to the pin hole and showing prior art kidney (tail) coring.

Referring to FIGS. 4 and 5, there is illustrated a knuckle 210 that shows prior art coring. The knuckle 210 may maintain the exterior geometry of a prior art knuckle and prior art coring, and be constructed to be lighter in weight than prior knuckles of the same geometry. One preferred knuckle, shown in FIGS. 4 and 5, is constructed from austempered metal, and more particularly austempered ductile iron or austempered steel. According to one preferred embodiment, the knuckle 210 may be similar to a prior knuckle geometry exterior, so that the knuckle is compatible with existing knuckles (including prior art knuckles) but is provided with thinner walls. Preferred embodiments having thinner walls preferably are constructed from an austempered metal, as discussed herein. The knuckle 210 is shown having a throat 221, pulling face 220, a tail 212 a nose 213, a pin hole 214 and a finger core hole 215. The knuckle 210 also has a locking face 226 and pulling lugs 218*a*, 218*b*. As shown in FIG. 4, the knuckle 210 is constructed with finger coring (dashed line) 216, pin coring (dashed line) 219 and kidney coring (dashed line) 217. According to a preferred embodiment, a knuckle 210 is provided having the prior art coring arrangement that is illustrated in FIGS. 4 and 5, but is constructed to be lighter in weight, yet suitably strong, to provide effective operation when deployed and used on railway vehicles. A preferred construction consists of austempered metal, and more preferably, austempered steel as well as austempered ductile iron. Alternate constructions may include austempered alloy steel, as well as other austempered metals and austempered metal alloys. FIG. 5 illustrates a side view of the kidney coring 219 of the tail 212. The tail wall 222 is shown having a uniform thickness for ease of manufacturing. An upper hub 225*a* and lower hub 225*b* also are illustrated.

Figure 6:
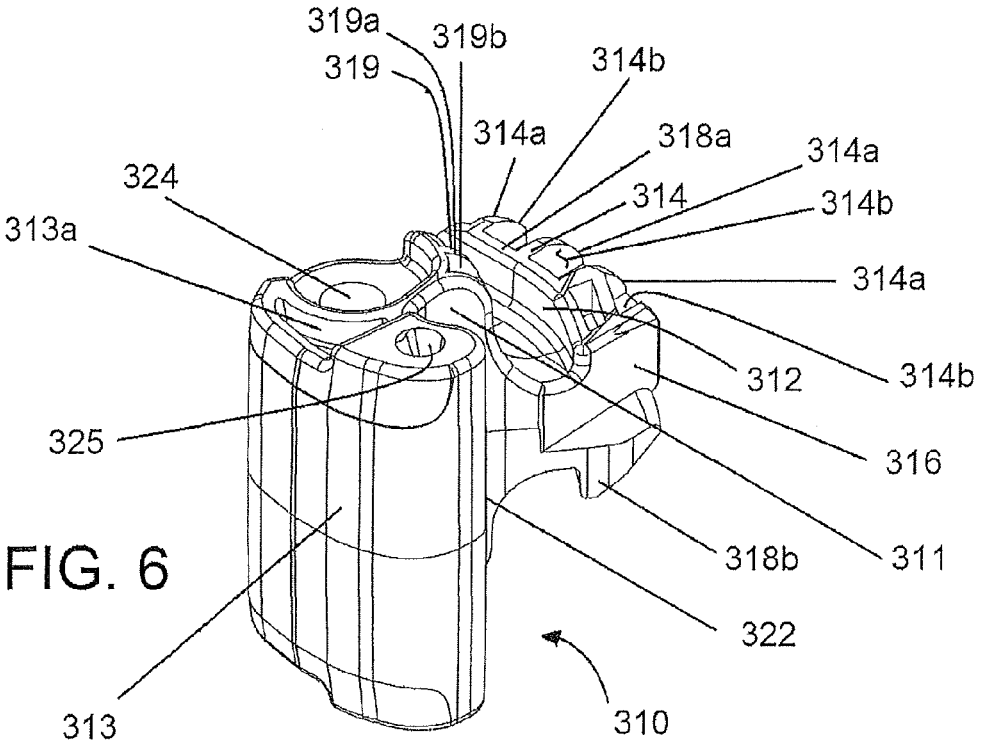
FIG. 6 is a perspective view of a preferred form of a knuckle constructed with a preferred coring configuration according to the present invention.
Figure 7:
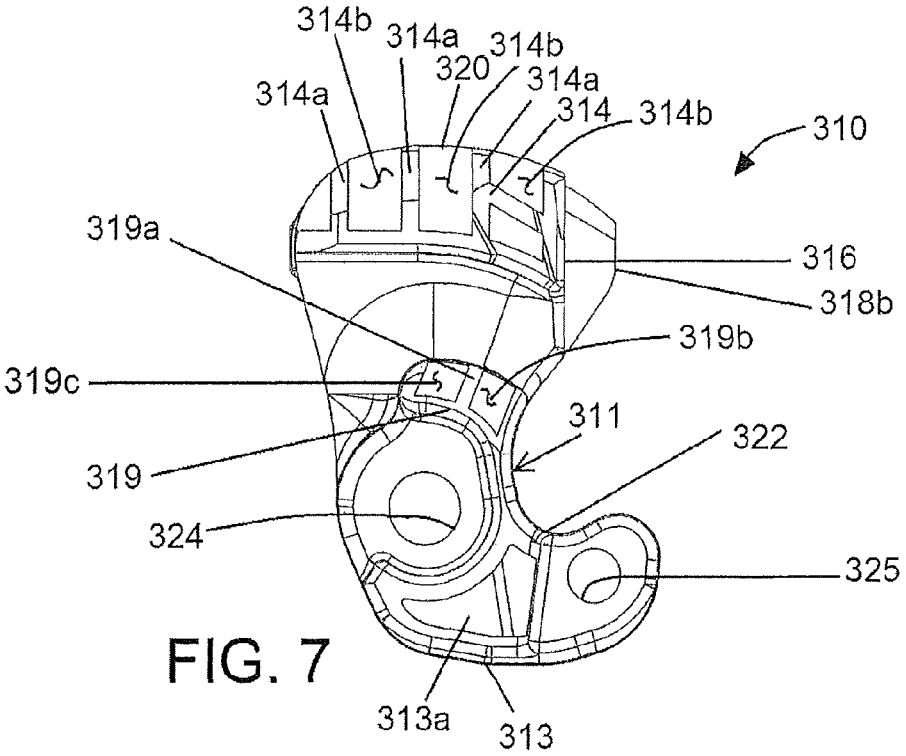
FIG. 7 is a top plan view of the knuckle of FIG. 6.
Figure 8:
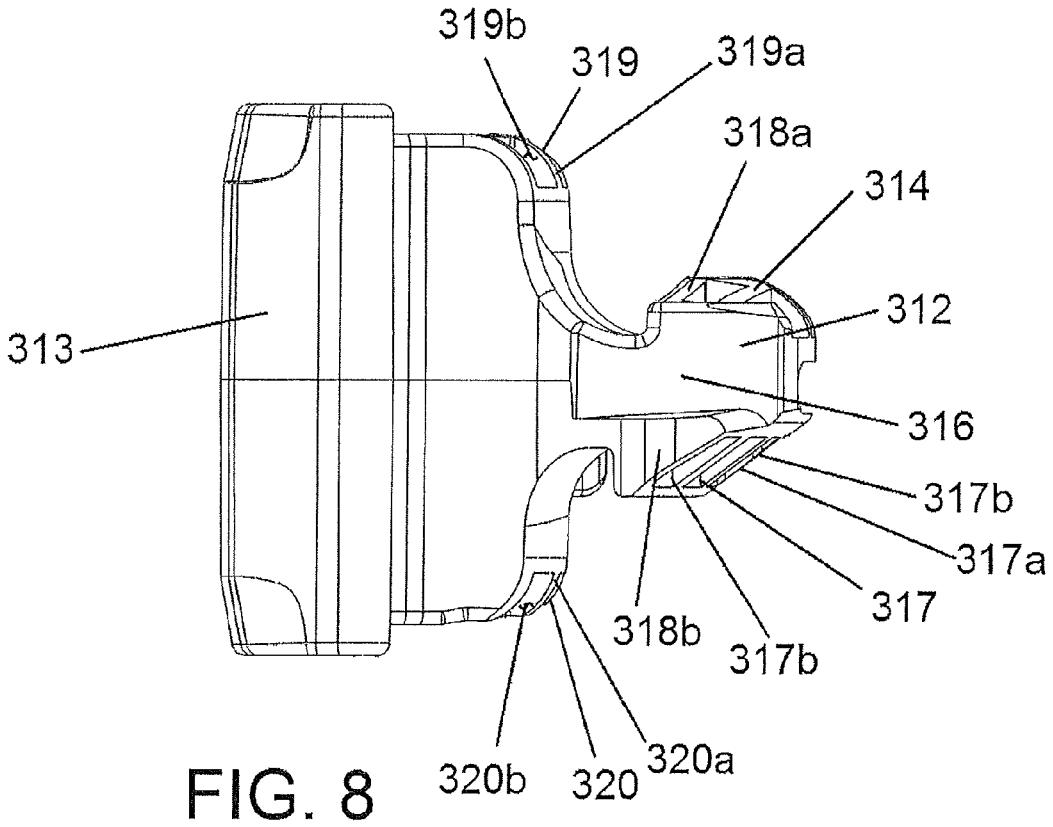
FIG. 8 is a right side elevation view of the knuckle of FIG. 6.

FIGS. 6-8 show the outside views of another preferred embodiment of the present invention, wherein a knuckle 310 is illustrated having a preferred construction that includes a preferred coring arrangement. The knuckle 310 preferably includes an exterior surface construction that allows compatibility with prior knuckles, although, as illustrated, the tail 312 may have an arrangement of coring 314 to provide reduced weight at the tail 312. The knuckle 310 has a tail 312, a pulling face 322, a throat 311 (FIG. 7), a nose 313, a pin hole 324 and a finger core hole 325. The knuckle 310 is illustrated also having pulling lugs 318*a* and 318*b*, and a locking face 316. The knuckle 310 also has a top guide 319 and a lower guide 320 (see FIG. 8). The knuckle 310 is shown in sectional views that illustrate some preferred exemplary sections having coring in designated locations or zones of the knuckle 310. As shown in FIGS. 6-8, the knuckle 310 has a first coring zone with outside coring 314, which includes a plurality of ribs 314*a* and interstices 314*b* provided in conjunction with the upper pulling lug 318*a*. According to a preferred embodiment, the ribs 314*a* may be interconnected, and the interstices 314*b* may be provided between ribs 314*a* or adjacent thereto. According to some preferred embodiments, ribs 314*a* may be spaced apart and interconnected to define the interstices 314*b*. As best illustrated in FIG. 8, the knuckle 310 is shown also having a second coring zone provided with coring for the lower pulling lug 318*b*. The second coring zone coring for the lower pulling lug 318*b* may have coring 317 which may be similar to the outside coring 314, as shown and described herein, and may be provided with ribs 317*a* and interstices 317*b*. The knuckle 310 is shown having a third coring zone provided with coring for the top guide 319. The third coring zone coring for the top guide 319 may have coring similar to the upper lug outside coring 314 and coring 317 for the lower pulling lug 318*b*, as shown and described herein. For example, according to one preferred coring arrangement, the third coring zone coring may include one or more of a rib 319*a* and interstice 319*b*, 319*c*. A fourth coring zone is shown provided with coring for the lower guide 320, which may be constructed similar to the other coring zones shown and described herein. For example, ribs 320*a* and interstices 320*b* may define the lower guide coring.

FIGS. 6-7 also show another feature that may be provided according to preferred embodiments, which includes a further nose coring zone 313*a*. The nose coring zone 313*a* may be provided by coring, or alternately, may be formed in the nose section by modifying the cope and drag portions of a mold used to form the knuckle 310, when the knuckle 310 is formed by a moulding process. Alternatively the knuckle could be made as an investment casting to have tighter tolerances, no draft on the pulling face and no parting line.

Figure 9:
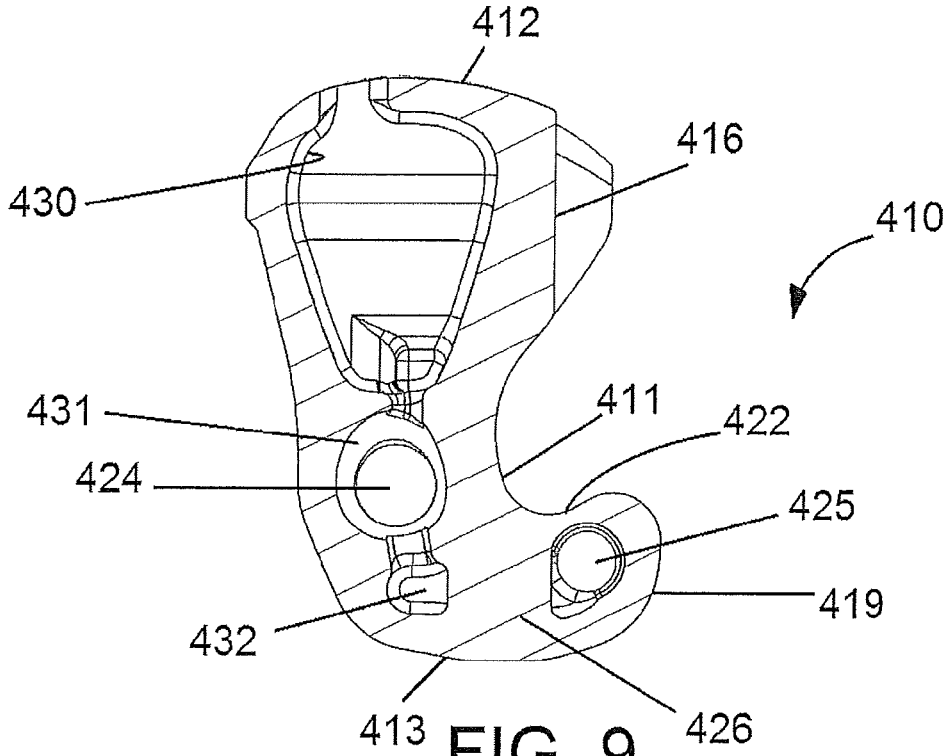
FIG. 9 is a sectional view taken horizontally through the knuckle, showing a knuckle embodiment with prior exterior knuckle geometry and being constructed from lightweight material, according to the present invention.
Figure 10:
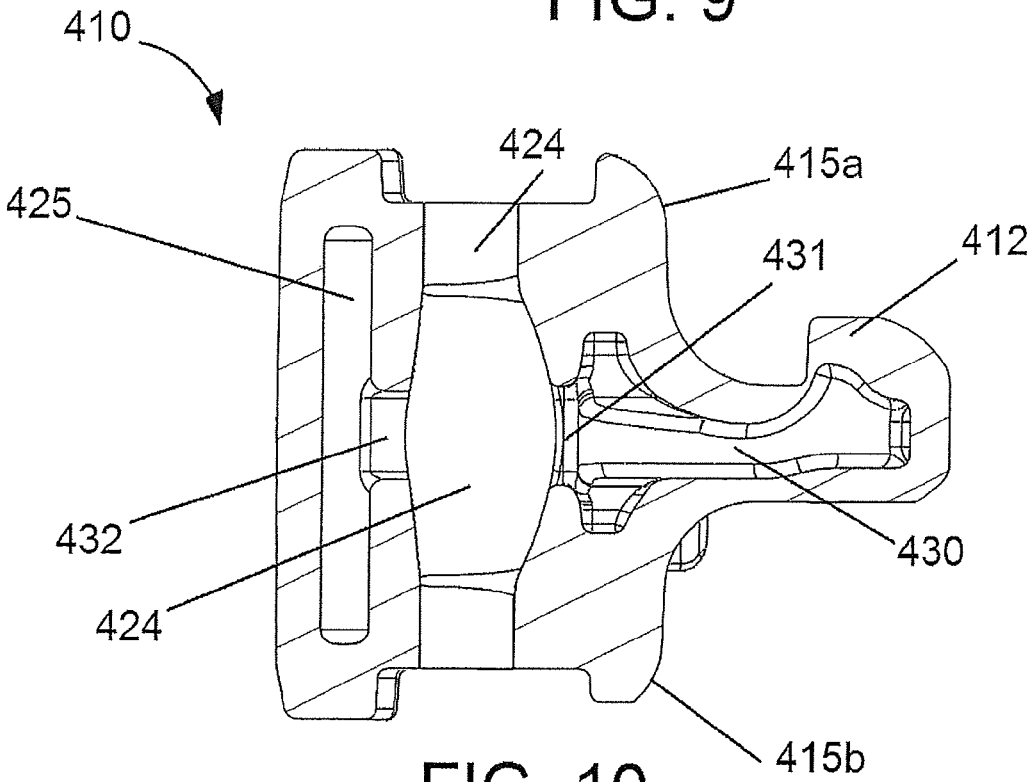
FIG. 10 is a right side, cross-sectional side view of the knuckle of FIG. 9 taken through a vertical plane of the knuckle of FIG. 9.

FIGS. 9-10 show cross-sectional areas of a preferred embodiment of a knuckle 410. According to one preferred embodiment, the knuckle 410 may be constructed with a geometry of a prior knuckle, but is composed of a lightweight material, such as, for example, an austempered metal, and more preferably from austempered ductile iron (including austempered ductile iron alloy) or austempered steel (including austempered alloy steel). According to another embodiment, the knuckle 410 further is configured with a preferred coring arrangement according to the present invention, and may have wall thicknesses that are suitably strong yet thin so as to reduce weight. Some exemplary wall thicknesses include those discussed herein, such as, for example, walls with thicknesses from between about 0.239 in and 1.7 in. According to some preferred embodiments, the throat wall, such as the wall of the throat 411, may be constructed having a thickness from between about 0.5 in and 1.7 in, and preferably from between about 0.75 in to 1.4 in, and more preferably from between about 0.8 in to 1.05 in for austempered ductile iron and ductile iron alloys. For austempered steel and steel alloys the wall of the throat 411, may be constructed having a thickness from between about 0.5 in and 1.0 in, and preferably from between about 0.55 in to 0.75 in, and more preferably from between about 0.55 in to 0.65 in. The knuckle 410 is shown according to a preferred embodiment including the provisioning of locations of prior knuckle coring, but with a preferred coring configuration that is constructed to be a lightweight knuckle in accordance with the present invention. The knuckle 410 is shown in FIGS. 9 and 10 having a preferred kidney core, 430, a preferred pin core 431, and a preferred section of the finger core 432. The knuckle 410 also is shown having a tail 412, a pulling face 422, a throat 411, a nose 413, a pin hole 424 and a finger core hole 425. Referring to FIG. 10, the knuckle 410 also has a top guide 415*a* and a lower guide 415*b*. Preferred embodiments of the knuckle 410 are constructed from an austempered metal and may have a preferred coring arrangement, such as the coring configuration shown in FIGS. 9-10. As shown in FIG. 9, the knuckle 410 is illustrated having a supporting structural portion, rib, 426 which supports the knuckle 410, including the knuckle finger section 419. According to some preferred embodiments, the supporting rib may be one large rib, such as the rib of the finger 426, and may be constructed having a thickness from between about 1.5 in and 3.0 in with a width of between about 3.0 in and 4.75 in, and preferably a thickness from between about 1.75 in and 2.75 in with a width of between about 3.5 in and 4.6 in, and more preferably a thickness from between about 2.0 in and 2.25 in with a width of between about 3.75 in and 4.25 in. According to some embodiments, the supporting structure may be constructed of two or more smaller ribs such as the rib of the finger 426, and according to preferred embodiments, may be constructed having a thickness from between about 0.5 in and 2.3 in with a width of between about 0.5 in and 1.7 in, and preferably a thickness from between about 1.00 in and 3.0 in with a width of between about 0.75 in and 1.3 in, and more preferably a thickness from between about 1.75 in and 2.75 in with a width of between about 0.9 in and 1.10 in.

Figure 11:
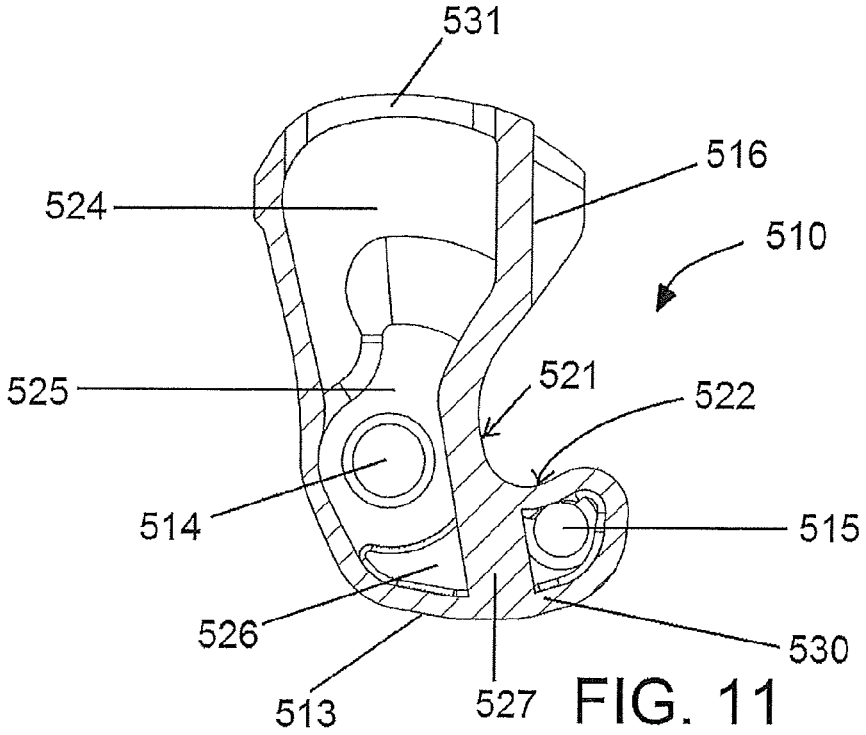
FIG. 11 is a sectional view of another preferred embodiment of a knuckle constructed according to the present invention, the sectional view being taken horizontally through the knuckle.
Figure 12:
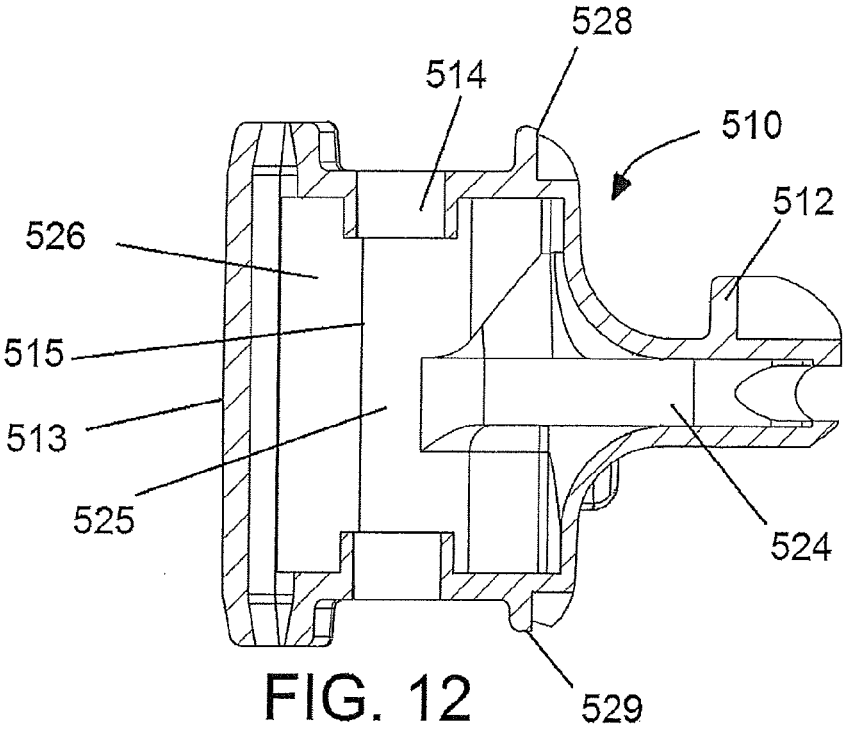
FIG. 12 is a right side sectional view of the knuckle of FIG. 11 taken through a vertical plane of the knuckle of FIG. 11.

FIGS. 11-12 show cross-sectional areas of a preferred embodiment of a knuckle 510 according to the present invention. The knuckle 510 is illustrated having a tail 512, a nose 513, a pin hole 514, a finger core hole 515, a throat 521, a pulling face 522 and a locking face 516. The knuckle 510 also has an upper hub 528 and a lower hub 529. These figures show an example of a preferred internal coring arrangement with a kidney core, 524, a pin core 525, and a section of the finger core 526 that all connect leaving basically an outside shell with some wall thicknesses. According to preferred embodiments, the wall thickness may define the pin hole 514 and finger core hole 515. FIG. 11 shows the knuckle 510 according to a preferred embodiment, with a supporting structural portion shown configured as a main support rib 527. The main support rib 527, according to a preferred embodiment, is disposed to span the length of the knuckle 510. As shown in FIG. 11, the main support rib 527 connects with the wall 530 at the nose end of the knuckle 510. In addition, the main support rib 527 also may connect with a wall 531 at the tail end of the knuckle 510. According to some preferred embodiments, the supporting rib may be two or more thinner ribs, such as the ribs of the finger 527, may be constructed having a thickness from between about 0.5 in and 2.3 in with a width of between about 0.5 in and 1.6 in, and preferably a thickness from between about 1.50 in and 3.0 in with a width of between about 0.75 in and 1.2 in, and more preferably a thickness from between about 2.0 in and 2.5 in with a width of between about 0.9 in and 1.10 in.

Figure 13:
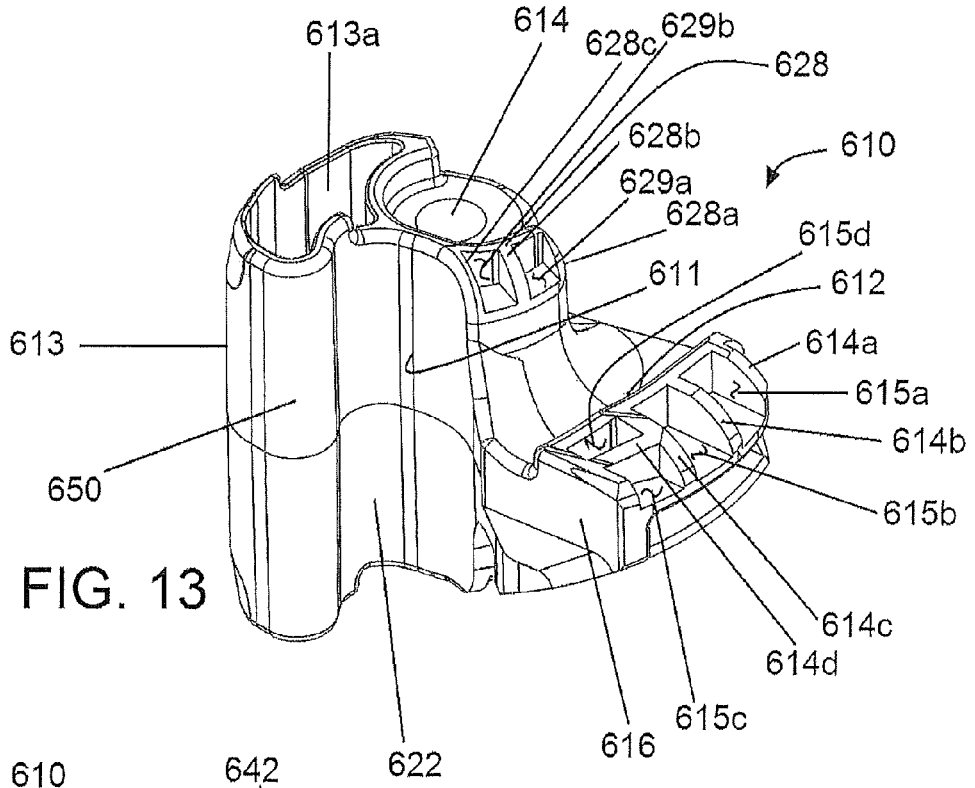
FIG. 13 is a perspective view of another preferred form of a knuckle constructed with another preferred coring configuration according to the present invention.
Figure 14:
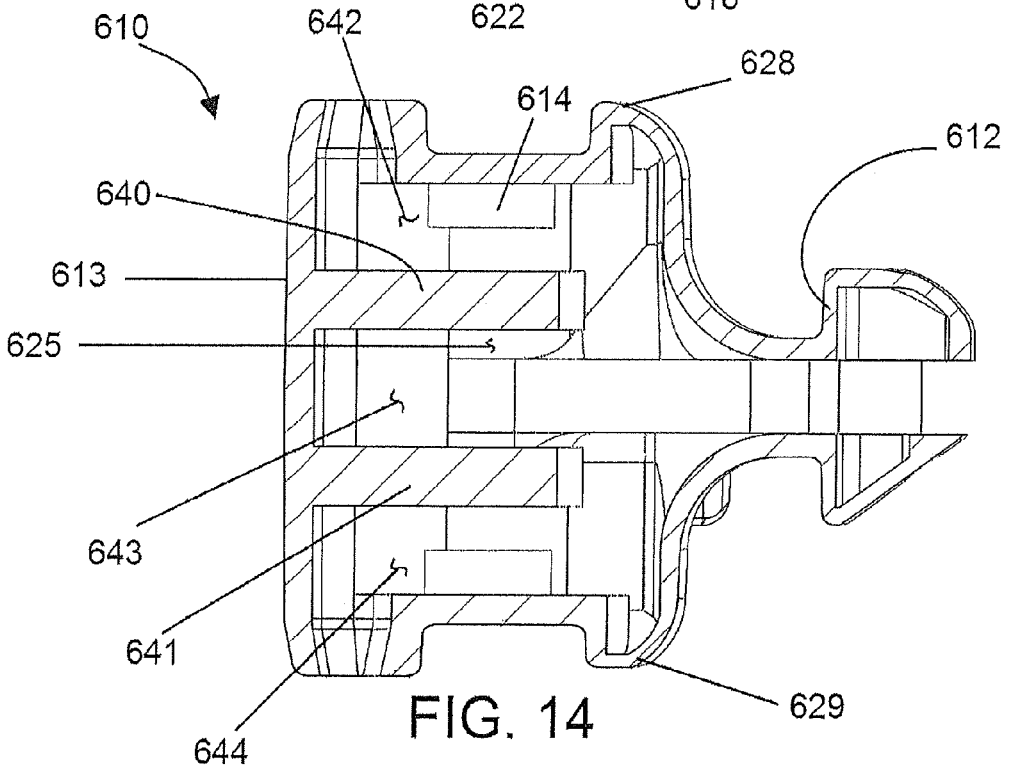
FIG. 14 is a right side, cross-sectional side view of the knuckle of FIG. 13 taken through a vertical plane of the knuckle of FIG. 13.

Referring to FIGS. 13 and 14, another preferred embodiment of a knuckle 610 is illustrated with a preferred coring arrangement, including an arrangement of ribs and spaces. The knuckle 610 is illustrated having a tail 612, a nose 613, a pin hole 614, a throat 611, a pulling face 622 and a locking face 616. The knuckle 610 also has an upper hub 628 and a lower hub 629. Coring 613*a* is shown provided in the nose section. Coring 613*a* preferably may be created using a core, or alternatively, may be created by modifying the cope and drag portions of the mold. Alternatively the knuckle could be made as an investment casting to have tighter tolerances, no draft on the pulling face and no parting line. According to a preferred embodiment, as illustrated, the nose coring 613*a* is expanded to encompass the nose area. According to a preferred embodiment, the tail 612 preferably is provided with coring that has an arrangement of ribs 614*a*,614*b*,614*c*,614*d* and interstices 615*a*,615*b*,615*c*,615*d*, and may be configured with preferred coring zones similar to those provided in the tail 312 and top guide 319 of the knuckle 310 shown in FIG. 6. The hub 628 is also shown with a coring arrangement of ribs 628*a*,628*b*,628*c* and interstices 629*a*,629*b*. The knuckle 610 may be constructed from any suitable material, and preferably metal, including cast grade E steel. According to a most preferred embodiment, the knuckle 610 is constructed from an austempered metal, such as, for example, austempered ductile iron, or austempered steel. The knuckle 610, as with the other knuckle embodiments disclosed herein, according to the invention, may be made from austempered metal, including austempered metal alloys, and according to preferred embodiments, includes one or more coring zones.

FIG. 14 shows a sectional view of the knuckle 610 constructed in accordance with a preferred coring arrangement, where interior coring zones are provided with ribs 640,641 and interstices 642,643,644. Preferably, the ribs 640,641 are provided to define the interstices 642,643,644, which the ribs may do in conjunction with an outer wall 650 (FIG. 13). According to preferred embodiments, ribs may be disposed to define features of the knuckles 610, such as, for example, the pin hole 614 and the expanded nose coring area 613*a*.

Figure 15:
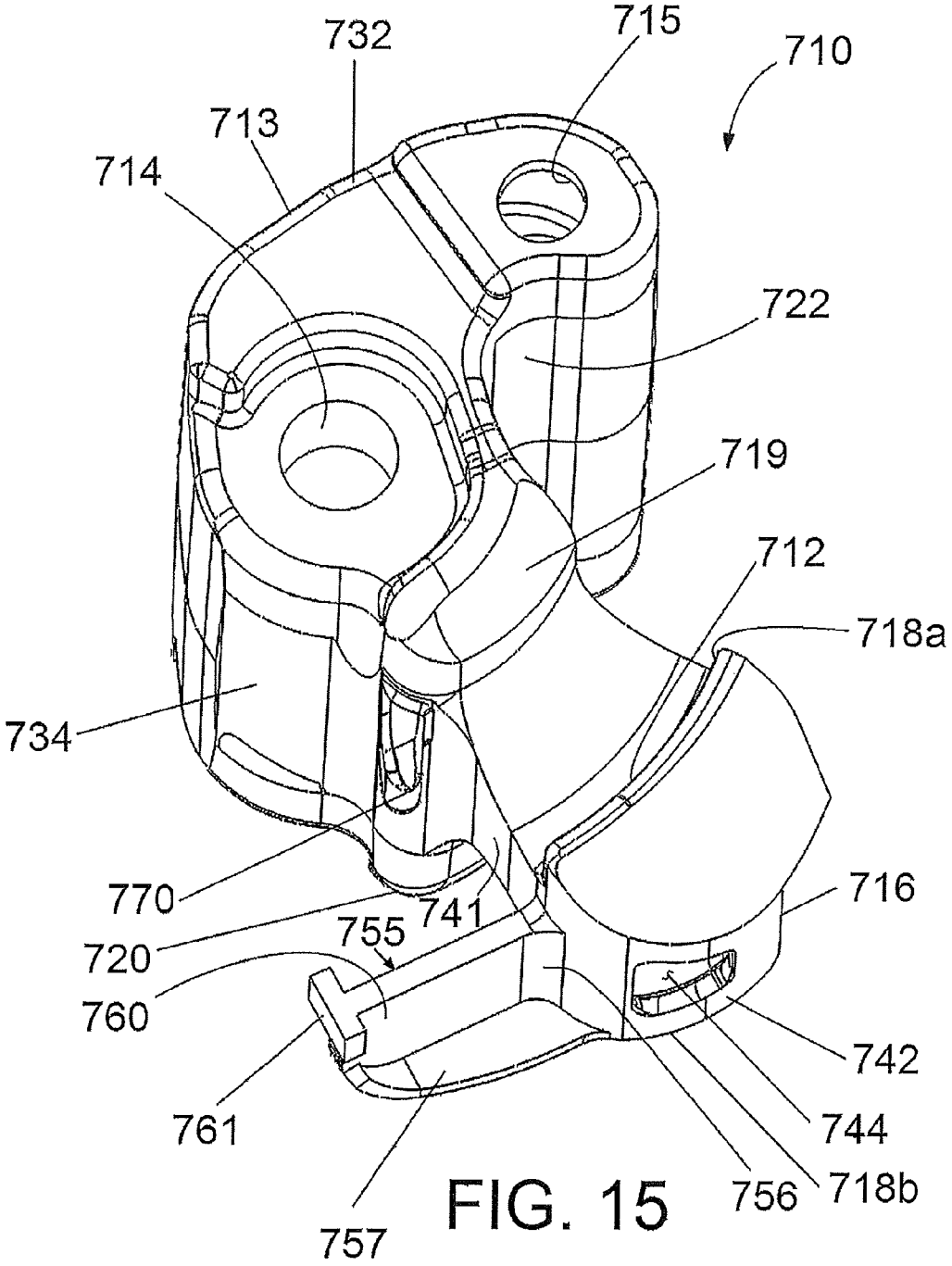
FIG. 15 is a perspective view of another preferred embodiment of a knuckle according to the present invention.
Figure 16:
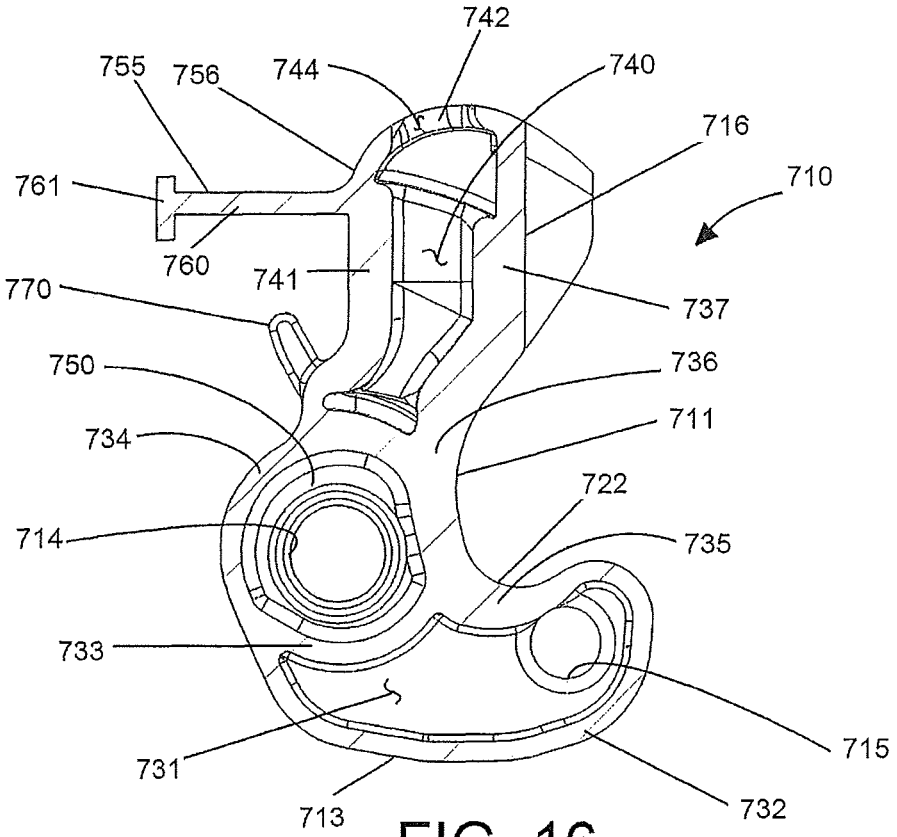
FIG. 16 is a sectional view taken through a horizontal plane of the knuckle of FIG. 15, as viewed from the bottom.
Figure 17:
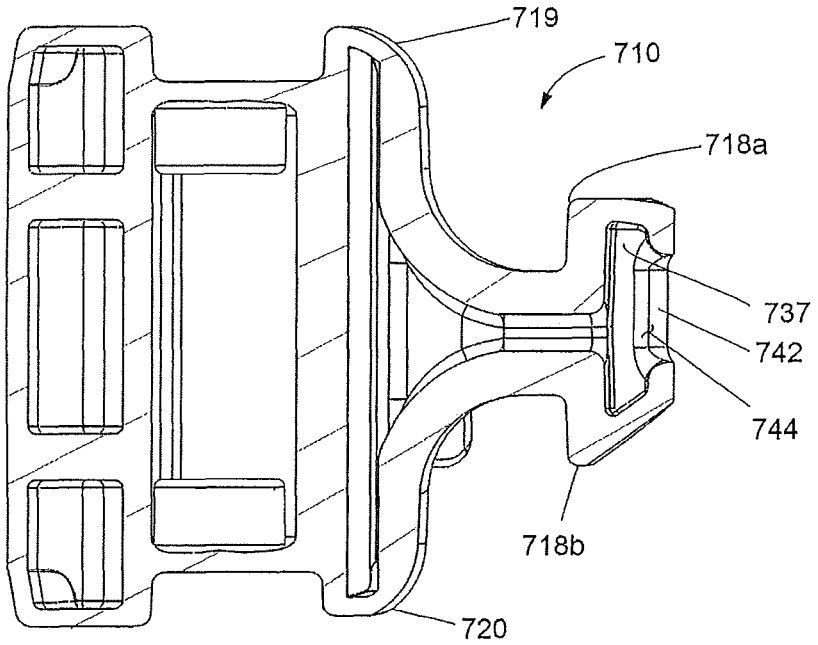
FIG. 17 is a cross-sectional side view of the knuckle of FIG. 15, taken vertically therethrough.

FIGS. 15-17 show another preferred embodiment of the present invention, wherein an improved lightweight knuckle 710 is illustrated with a preferred construction having an arrangement of walls with coring. The knuckle 710 preferably includes an exterior surface construction that allows compatibility with prior knuckles, The knuckle 710 has a tail 712, a pulling face 722, a throat 711 (FIG. 16), a nose 713, a pin hole 714 and a finger core hole 715. According to a preferred embodiment, as illustrated in FIG. 16, the finger core hole 715 is formed in the nose section, and preferably, nose coring 731 is provided in the nose 713. The nose 713 includes a nose wall 732. The finger core hole 715 may be defined by one or more supporting structural elements, such as, for example, ribs (not shown) that may connect with the nose wall 732. In the embodiment illustrated, the nose coring 731 is bordered by the nose wall 732 and a connecting wall 733. The connecting wall 733 is disposed partially around the pin hole 714 and pin hole coring 750, and is shown joining with the nose side wall 734 and one or more of the pulling face wall 735 or throat wall 736. According to a preferred embodiment, the pulling face wall 735, throat wall 736, or both, may also border the nose coring 731. The nose wall 732 makes a turn near the finger core hole 715 and forms a pulling face wall 735 that supports the pulling face 722 thereon. The pulling face wall 735 preferably is continuous with the nose wall 732, and, as illustrated in FIG. 16, may have a thicker cross-sectional dimension at the location along, across, or near the pulling face 722. The pulling face wall 735 returns to the tail 712, and preferably is continuous with a throat wall 736 that supports the throat 711 and a locking face wall 737 that supports the locking face 716. According to a preferred embodiment shown, the locking face wall 737 preferably defines the tail coring 740, which it may do in conjunction with one or more additional walls or wall portions provided in the tail 712. The tail 712, as illustrated in the embodiment of the knuckle 710, is further defined by a tail end wall 742 and a tail side wall 741. The tail side wall 741 is illustrated disposed opposite the locking wall 737. The locking wall 737 and tail side wall 741 join with the tail end wall 742. Preferably, the tail coring 740 is defined by the locking wall 737, the tail side wall 741 and tail end wall 742. The tail end wall 742 preferably has a window 744 formed therein. The tail side wall 741 is shown joining with the nose side wall 734. Pin hole coring 750 is provided between the connecting wall structure 733, the nose side wall 734 and the throat wall 736 (which are illustrated joining to span across the knuckle 710 to define the pin hole coring 750 on one side thereof, and the tail coring 740 on the other side thereof.

The tail section further includes a stopping bar 755 extending outwardly from the tail side wall 741. The stopping bar 755 is shown in a preferred exemplary configuration as an arm having a generally "T"-shape, with a flanged connecting portion 756 connecting with the tail side wall 741. The stopping bar 755 includes a body portion 760 and a head portion 761 connected to the end of the body portion 760. A lower flange 757 is disposed at the bottom of the stopping bar 755. According to a preferred embodiment, the stopping bar 755 is disposed on the opposite side of locking face 716. A finger 770 is provided extending outwardly from the knuckle 710 in a direction toward the stopping bar 755 and forming a space between the tail side wall 741 and the finger 770. Although the stopping bar 755 is illustrated in a preferred embodiment having a generally "T"-shaped configuration, the stopping bar 755 may be constructed in alternate configurations.

As best shown in FIGS. 15 and 17, the knuckle 710 is illustrated also having pulling lugs 718*a* and 718*b*, and a locking face 716. The knuckle 710 has a top guide 719 and a lower guide 720 (see FIG. 17). The knuckle 710 is shown in sectional views that illustrate some preferred exemplary sections having coring in designated locations or zones of the knuckle 710. As shown in FIGS. 15-17, the knuckle 710 has a first coring zone with nose coring 731 in the nose 732 of the knuckle 710. According to a preferred embodiment, a wall portion 733 defines, in part, the nose coring 731. Although not shown, the nose 712 may be constructed with ribs. For example, as illustrated herein in connection with alternate embodiments, ribs may be interconnected, and there may be interstices provided between ribs, or adjacent thereto. According to some preferred alternate embodiments, ribs may be spaced apart and interconnected to define the interstices. Some embodiments may have external ribs, while other embodiments may have internally formed ribs.

The knuckle 710, according to an alternate embodiment, may be provided with alternate interior coring zones and interior ribs (although not shown) in the tail section, nose section, or in both sections, of the knuckle 710.

The knuckle 710 may be constructed from steel, including, for example, grade E cast steel. According to alternate embodiments, the knuckle 710 may be constructed from an austempered metal, such as, austempered ductile iron, austempered ductile iron alloys, austempered steel, and austempered steel alloys.

Figure 18:
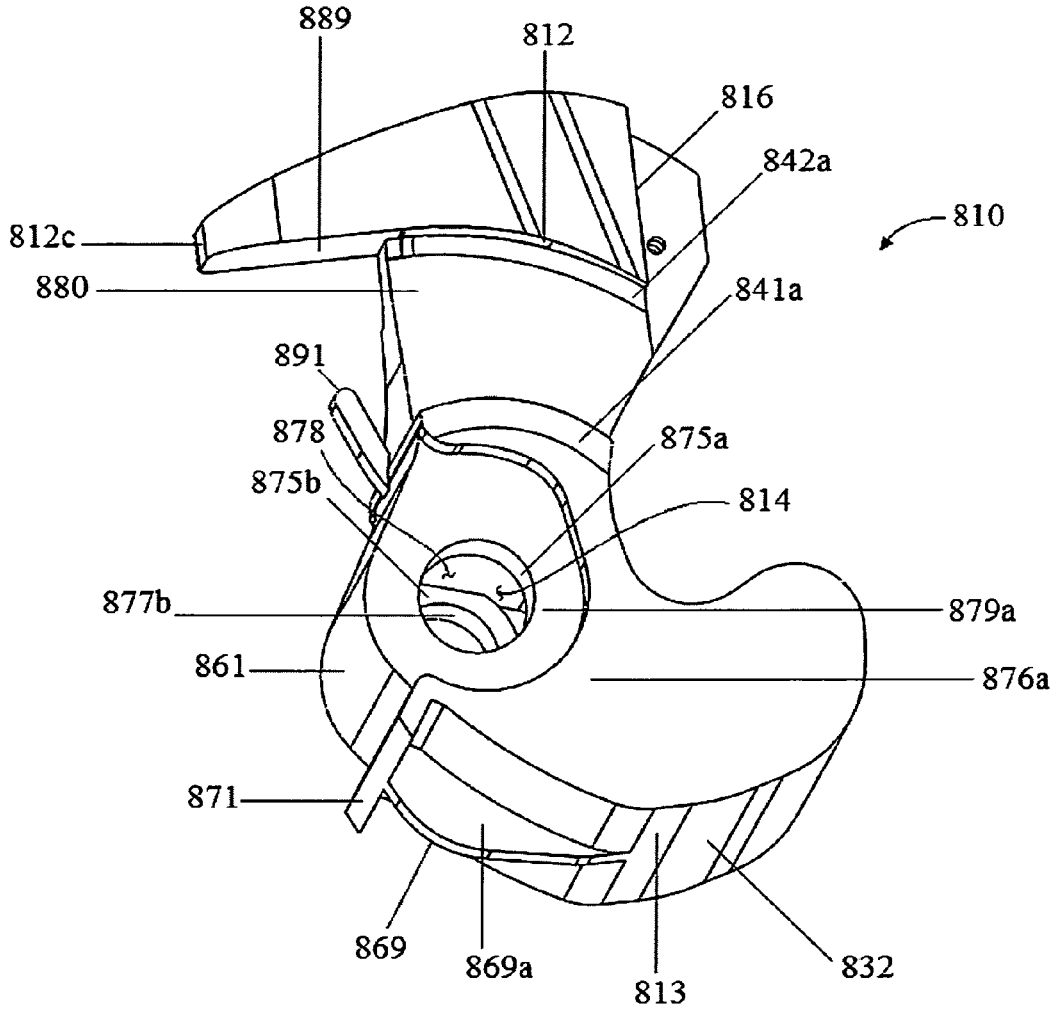
FIG. 18 is a perspective view of another preferred embodiment of a knuckle according to the present invention.
Figure 19:
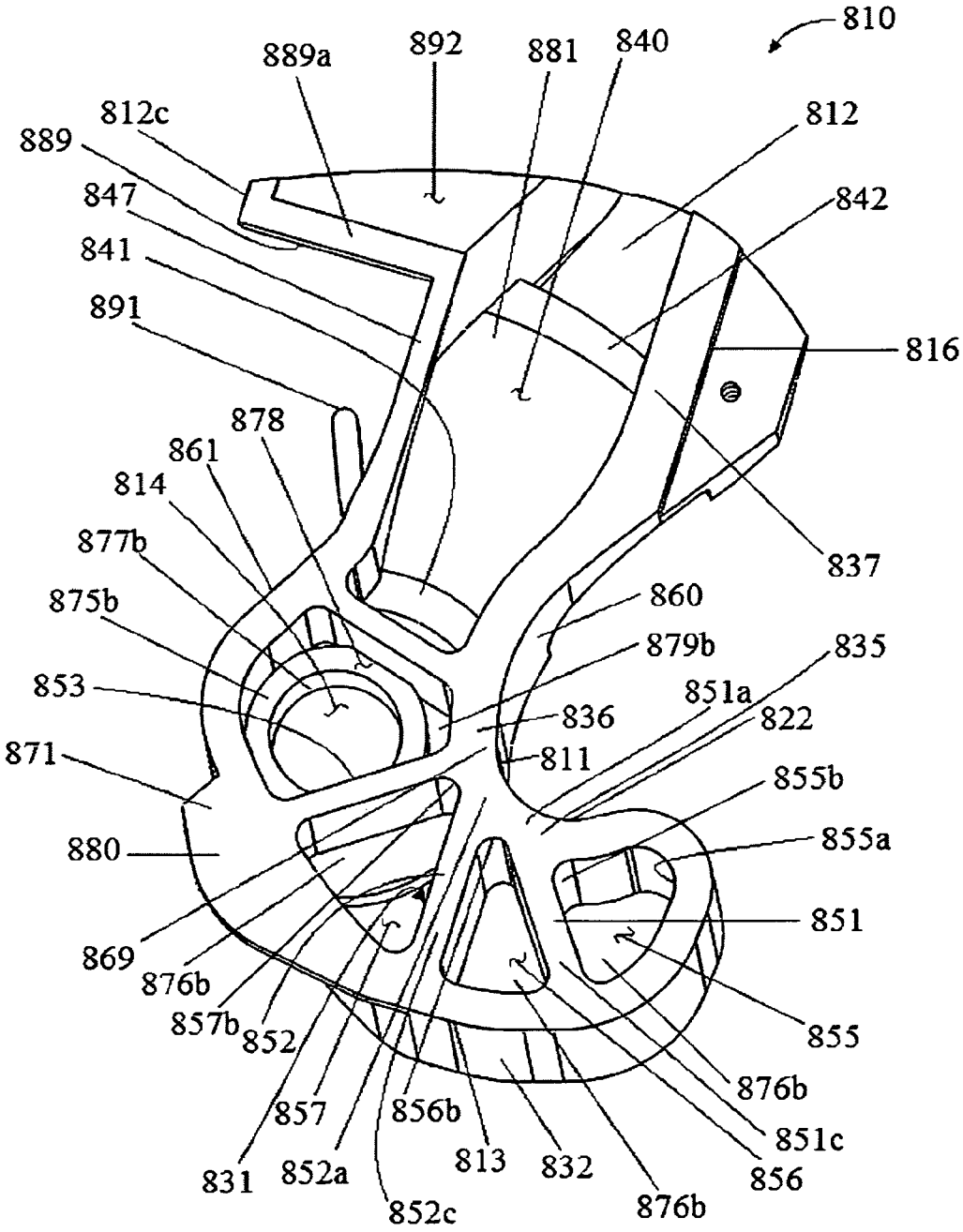
FIG. 19 is a sectional view taken through a horizontal plane of the knuckle of FIG. 18, as viewed from the top in the perspective shown in FIG. 18.

FIGS. 18-22 show another preferred embodiment of the present invention, wherein an improved lightweight knuckle 810 is illustrated with a preferred construction having an arrangement of walls with coring. The knuckle 810 is shown, according to a preferred embodiment, including an exterior surface construction that permits compatibility with prior knuckles. The knuckle 810 has a tail 812, a pulling face 822, a throat 811, a nose 813, and a pin hole 814. The nose 813 includes a preferred coring arrangement of nose coring 831 provided in the nose 813. The nose coring 831 preferably is extended in an arrangement that encompasses and supports the pin hole 814. The nose 813 includes a nose wall 832. As illustrated in FIG. 19, an arrangement of supporting structural elements, such as, for example, ribs 851, 852, 853, 854. According to a preferred embodiment, the ribs 851, 852, 853, 854 may be configured as vertical walls. The first rib 851 and second rib 852 connect with the front portion of the nose wall 832. Preferably, the first rib 851 and second rib 852 each has a first end 851*a*, 852*a*, respectively, which make a connection with the right side wall 860 of the knuckle 810, and preferably, with the portion of the right side wall 860 that forms the throat wall 836, the portion that forms the pulling face wall 835, or both. The first rib 851 is shown connected at its second or nose end 851*c* to the nose wall 832. The second rib 852 also is connected at its second or nose end 852*c* to the nose wall 832. A third rib 853 spans between the right side wall 860 and the left side wall 861. A fourth rib 854 also is shown spanning between the right side wall 860 and the left side wall 861.

As illustrated, the right side wall 860 joins the nose wall 832 at the nose 813 of the knuckle 810 and extends to the tail 812, forming the pulling face wall 835 and throat wall 836 therebetween. The left side wall 861 joins the nose wall 832 and extends to the tail 812. According to a preferred embodiment, one or more of the ribs 851, 852, 853, 854 preferably are joined together at at least one end thereof. According to the exemplary embodiment illustrated in FIG. 19, the ribs are arranged in a preferred configuration with the first rib 851, second rib 852 and third rib 853 joining together at the throat wall 836, at a hub 870. The hub 870 preferably may span between the rib arrangement so that the ribs connect at the hub 870. According to a preferred embodiment, the ribs, such as those ribs 851, 852, 853, 854, may be arranged with conjoined vertices. One or more of the conjoined rib vertices preferably fond a hub 870. The hub 870 is disposed at a location to facilitate receipt and distribution of force loads associated with pulling forces from other couplers or knuckles that matingly connect with the knuckle 810 and exert forces against the pulling face 822 through engagement therewith.

The knuckle 810 is shown having a peripheral flange 869 provided at the nose portion of the knuckle 810, and preferably connected to the nose wall 832 and the left side wall 861. A vertical wall 871 is shown extending from the left side wall 861 and bordering the peripheral flange 869 along its left edge. The peripheral flange 869 has a ledge 869*a* which preferably is disposed at a location near one or more of the second ends of the ribs 851, 852, 853, 854 at the left side wall 861 or nose wall 832.

Figure 20:
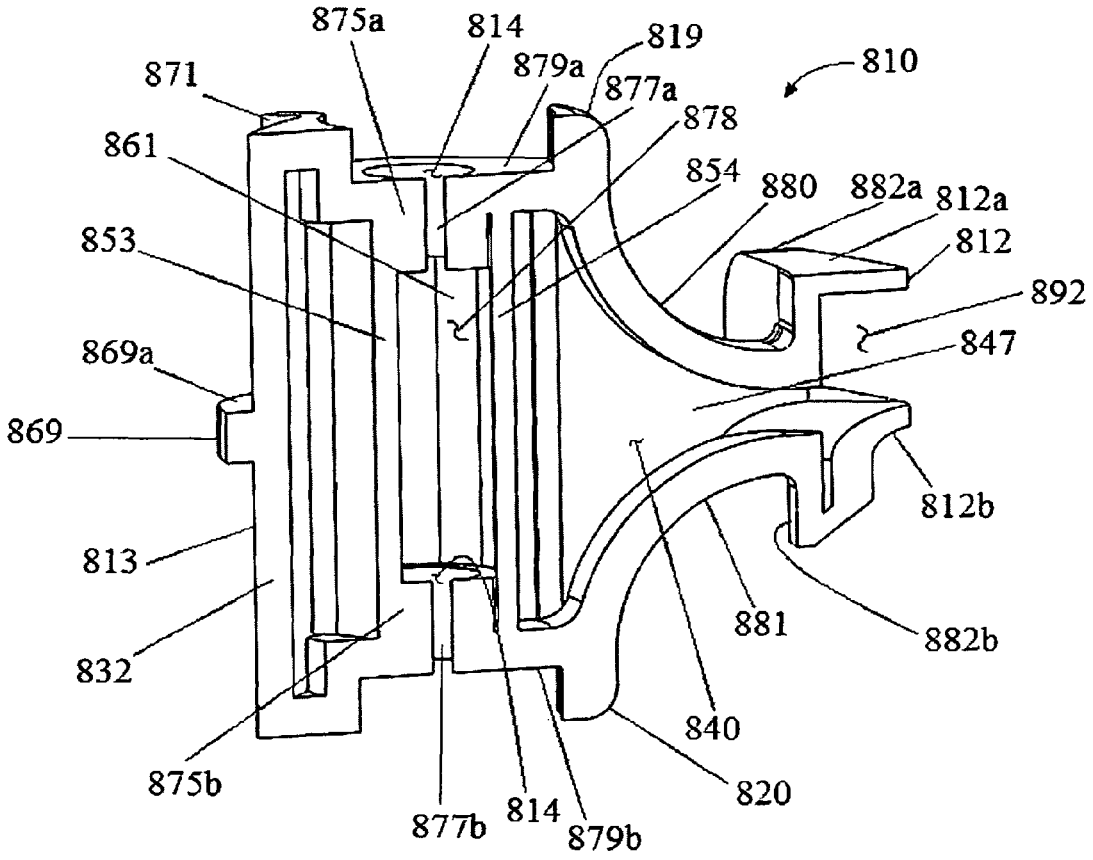
FIG. 20 is a cross-sectional side view of the knuckle of FIG. 18, taken vertically therethrough.

The pin hole 814 is shown disposed between ribs, particularly, the third rib 853 and the fourth rib 854. The pin hole 814 opens at the upper surface 876*a* and lower surface 876*b* of the knuckle 810, and preferably, at the recessed surface portions 879*a*, 879*b*, respectively. The pin hole 814 is defined by a lower annular flange 875*b* which, as shown in FIGS. 18 and 20, has a thickness or vertical height and connects with the recessed lower surface 879*b* (see FIG. 21) defining an end of the lower flange 875*b*, and with an annular vertically disposed wall 877*b* forming the vertical thickness of the lower flange 875*b*. Similarly, the pin hole 814 also is defined by an upper annular flange 875*a*, which has an annular vertically disposed wall 877*a* (FIG. 18) forming the vertical thickness of the upper flange 875*a*. The upper flange 875*a* is shown connected to the recessed upper surface 879*a* (see FIG. 18). The third rib 853 and fourth rib 854 define a pin hole coring 878. The pin hole coring 878, as illustrated in the preferred embodiment shown in FIG. 19, is bordered by the left side wall 861 and the right side wall 860, with the third rib 853 and fourth rib 854 spanning between the side walls 860, 861. As illustrated in FIG. 20, preferably, the pin hole 814 has an upper portion that includes the upper annular flange 875*a* with upper annular wall 877*a*, and has a lower portion that includes a lower annular flange 875*b* with lower annular wall 877*b*. The lower flange 875*b* and wall 877*b*, may be constructed like the upper pin hole portion. The pin hole 814 is formed by the upper wall 877*a* and lower wall 877*b* and is further accommodated by the pin hole coring 878 between the upper pin hole portion and lower pin hole portion.

According to a preferred embodiment, the nose wall 832 makes a turn near the hub 870 and merges to form a pulling face wall 835 that supports the pulling face 822 thereon. The pulling face wall 835 preferably is continuous with the nose wall 832, and, as illustrated in FIG. 19, may have a section at or near the pulling face 832 or throat 811 that joins with one or more of the ribs 851,852,853,854. The right side wall 860 continues from the throat 811 to the tail 812, where a locking face wall 837 is provided and supports a locking face 816 thereon. According to a preferred embodiment, the locking face wall 837 along with the left side wall 861, and in particular the tail side wall 847, define a preferred tail coring 840. According to a preferred embodiment, the fourth rib 854 is disposed to border the tail coring 840 on one side thereof and the pin core or coring 878 on the other side thereof. A mid rib wall 841 is shown disposed below the upper surface 841*a* (FIG. 18) and spanning through the tail core 840. A rear rib 842 is shown at the tail end of the tail core 840, and is disposed spanning through the tail core 840 and positioned below the upper surface 842*a* (FIG. 18). The left side wall 861 preferably includes a tail side wall 847 which is disposed opposite the locking wall 837. The locking wall 837 and tail side wall 841 join with the upper medial surface 880 and lower medial surface 881 of the knuckle 810. As shown in FIG. 20, the knuckle 810 has a tail core 840 disposed below the upper medial surface 880 and lower medial surface 881. Preferably the medial surfaces 880, 881 span to the tail 812, and preferably are located between the pin core 878 and the tail 812.

Figure 22:
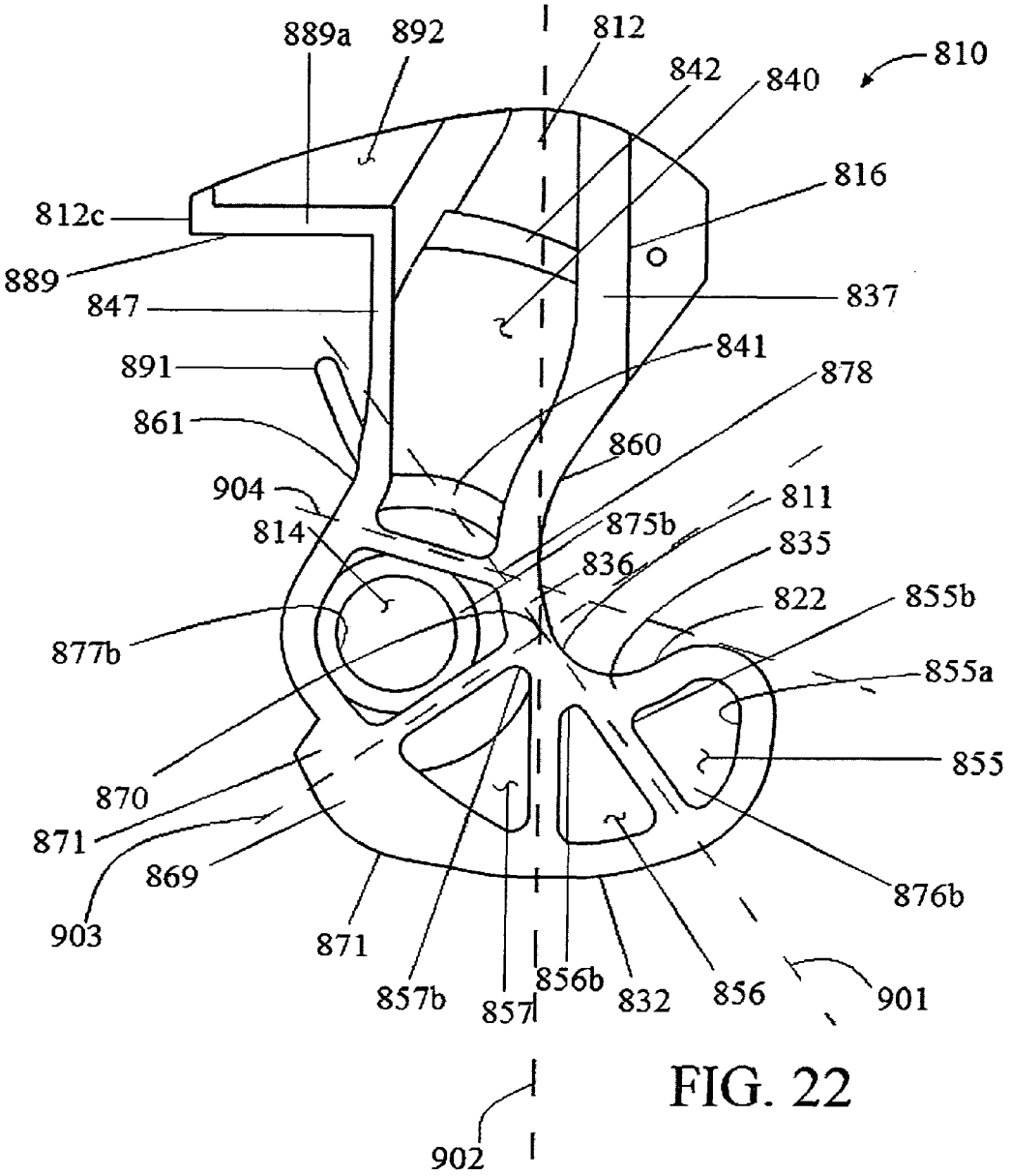
FIG. 22 is a sectional view taken through a horizontal plane of the knuckle of FIG. 18, showing the section of the knuckle shown in FIG. 19, but with the section being viewed as a plan view looking from the top.

Referring to FIGS. 19 and 22, according to a preferred arrangement, the ribs 851,852, 853,854 are illustrated forming a series of cores, including a first nose core 855, a second nose core 856, a third nose core 857 and the pin hole core 878. The first nose core 855 is formed with a bordering wall section 855*a*, which is illustrated forming a portion of the right side wall 860 of the knuckle 810 (or side of the nose wall 832). The first nose core 855 also has a vertex 855*b* where the first rib 851 joins the right side wall 860. A second nose core 856 is formed by the first rib 851 on one side thereof, the second rib 852 on the other side thereof, and the nose wall 832 on a third side. A vertex 856*b* defines an end of the second core 856 and is shown being located at the joinder of the first rib 851 and second rib 852. A third nose core 857 is provided and is formed by the second rib 852 on one side thereof, the third rib 853 on the other side thereof, and the nose wall 832 on a third side. A vertex 857*b* defines an end of the third core 857 and is shown located at the joinder of the second rib 852 and third rib 853.

Figure 21:
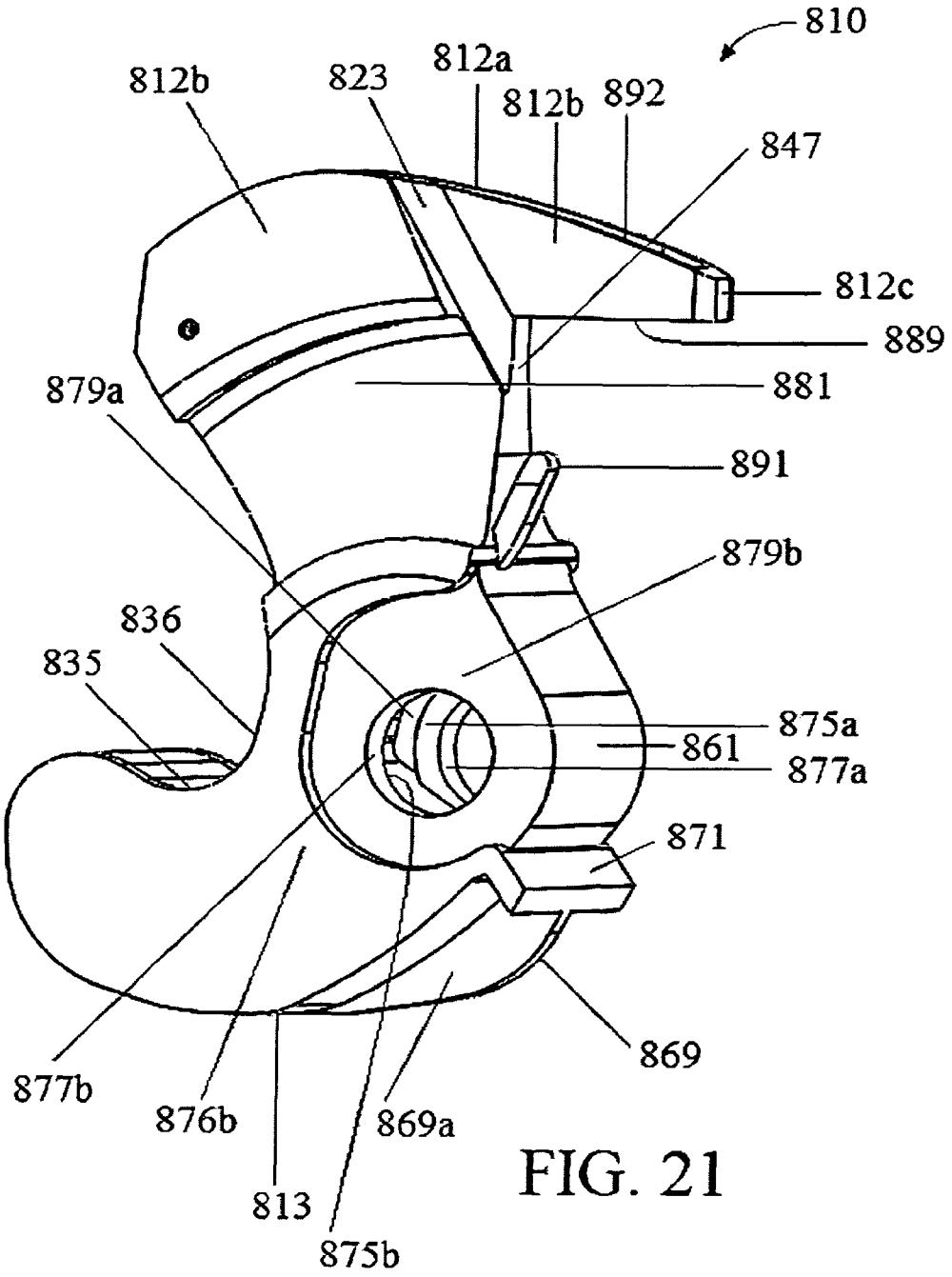
FIG. 21 is a perspective view of the knuckle of FIG. 18 viewed looking at the bottom thereof.

According to a preferred embodiment, the tail 812 preferably has an opening or core 892 between the upper tail wall portion 812*a* and lower tail wall portion 812*b*. The upper tail wall portion 812*a* and lower tail wall portion 812*b* preferably are connected at at least one end, as shown in FIG. 21, where the connecting portion 812*c* connects with each wall portion 812*a*,812*b*. A lower tail rib 823 is shown connecting with the lower tail wall portion 812*b*. A stopping bar arm 889 is shown and preferably is formed by a stopping bar wall 889*a* (FIG. 19) which is shown connected to the tail side wall 847. A finger 891 is provided extending outwardly from the knuckle 810 in a direction toward the stopping bar arm 889 and forming a space between the tail side wall 847 and the finger 891.

According to a preferred configuration, as illustrated in FIG. 22, reference lines 901, 902, 903 and 904, are shown passing through each respective rib, including the first rib 851, second rib 852, third rib 853 and fourth rib 854. The reference lines 901,902,903 and 904 are imaginary lines shown for illustrating one or more features of preferred configurations. The reference lines 901,902,903 and 904 extend through the respective ribs 851,852,853,854. According to a preferred embodiment, each reference line 901,902,903 and 904 preferably is provided in a center location within a respective rib. Each reference line, 901,902,903 and 904, preferably has a band width on each side thereof, representing a band space. According to a preferred embodiment, the band space may be equal to the width of the respective rib, 851, 852,853,854 through which the respective reference line is drawn. According to one preferred arrangement, ribs may be arranged in a configuration with a plurality of the rib reference lines 901,902,903 and 904 intersecting each other. According to preferred embodiments, a plurality of the rib reference lines 901,902,903 and 904 preferably intersect at the hub 870. As illustrated in FIG. 22, the embodiment shows a preferred arrangement of the ribs where at least some of the rib reference lines intersect at a location within the knuckle 810, and where at least some other of the rib reference lines intersect at a location exterior of the knuckle 810, and beyond the knuckle side wall 860.

As best shown in FIG. 20, the knuckle 810 has pulling lugs 882*a*, 882*b* and a locking face 816 (see FIGS. 18 and 19). The knuckle 810 has a top guide 819 and a lower guide 820 (see FIG. 20). The knuckle 810 is shown in sectional views that illustrate some preferred exemplary sections having coring in designated locations or zones of the knuckle 810.

The knuckle 810 may be constructed from steel, including, for example, grade E cast steel. According to alternate embodiments, the knuckle 810 may be constructed from an austempered metal, such as, austempered ductile iron, austempered ductile iron alloys, austempered steel, and austempered steel alloys.

The arrangement of coring, ribs and wall thickness, may be provided to produce a knuckle that is lighter in weight, but possesses sufficient strength, including meeting or exceeding railroad standards, such as AAR standards for knuckles. In addition, the knuckle embodiments may be produced from austempered metal, such as, for example, austempered ductile iron, which is lighter in weight than grade E cast steel, but provides equal or greater strength, to provide a lightweight knuckle that is constructed from ADI and has an arrangement of ribs and/or coring.

According to some preferred embodiments, the knuckles may be constructed with wall thicknesses, which preferably may be between about 0.239 in and 1.7 in, more preferably between about 0.30 in and 1.05 in, and most preferably between about 0.31 in and 0.75 in. The knuckle shell, as it may sometimes be referred to denote the walls of the knuckle, may be provided having these thicknesses. For example, knuckle walls, such as, for example, the throat wall and other exterior walls, as well as other walls, such as those walls defining a finger core hole or a pin hole, may be constructed having a wall thicknesses of between about 0.239 in and 1.7 in, more preferably between about 0.30 in and 1.05 in, and most preferably between about 0.31 in and 0.87 in. Knuckles according to some preferred embodiments of the present invention may be constructed having one or more or both, internal ribs and external ribs. Some examples of preferred embodiments where ribs are provided are shown and described in the figures and the accompanying detailed description. In addition, according to some preferred embodiments, the knuckle may be constructed wherein the pulling face is devoid of draft angles along the pulling face. Furthermore, further strengthening of the knuckles shown and described herein may be accomplished by providing shot peened surfaces. For example one or more of the top and bottom pulling lugs, the tail, the pulling face, the throat, the reinforcing ribs, outside surface, inside surface, as well as combinations of these may be provided with a shot-peened surface. The shot-peened surfaces may include inner surfaces and outer surfaces of the knuckle, including the surfaces of ribs.

According to some preferred embodiments, the knuckles shown and described herein, in accordance with the invention, may be constructed from an austempered metal that possesses tensile strength, yield and elongation, respectively, of from about 190 KSI, 160 KSI, and 8% and about 205 KSI, 175 KSI and 5%, wherein KSI is one thousand pounds per square inch. One suitable austempered metal that may be used to construct the knuckles shown and described herein is austempered ductile iron. According to an exemplary embodiment, the knuckles may be constructed from austempered ductile iron by a casting method.

According to preferred embodiments of the invention, lightweight knuckles may be constructed from grade E stainless steel, such as for example, knuckles configured with one or more weight reduction zones, that may comprise zones of coring and/or ribs, which reduces the weight of the knuckle. According to other preferred embodiments, lightweight knuckles, including the knuckles shown and described herein, as well as knuckles configured with a construction of one or more weight reduction zones, are constructed from an austempered metal, preferably austempered steel, austempered ductile iron, austempered steel alloy or austempered ductile iron alloy. Preferred compositions, such as steel, as well as alloy steel compositions, e.g., alloyed preferably with magnesium, manganese, molybdenum, copper or mixtures thereof, or more preferably, with chromium, nickel or mixtures thereof, (or mixtures of the preferred and more preferred metals), may be used to form the knuckles, as discussed and shown herein. The steel or preferred/more preferred alloy steel composition is austempered to obtain tensile strength, yield, and elongation properties for the inventive knuckles which are suitable to meet or exceed the AAR standards for coupler knuckles, including the current standard set forth by the American Association of Railroads (AAR) in AAR Manual of Standards and Recommended Practices, such as current standards M-211, M-216, M-205, M-220 NDT and Rule 88 of the AAR Office Manual, the complete contents of which are herein incorporated by reference. Knuckles may be constructed from ductile iron that is austempered. The ductile iron also may be used in alloy form, preferably, with nickel, molybdenum, manganese, copper, or mixtures thereof, and the ductile iron alloy austempered to form knuckles.

The knuckles may be constructed in accordance with a suitable forming method, such as, for example, a casting method, used to produce a coupler knuckle that meets or exceeds the AAR coupler standards. According to a preferred embodiment, knuckles according to the invention may be manufactured through a casting process with a metal, such as ductile iron (DI), steel or alloys of either, or other metal alloys, and then austempered after casting.

Lightweight knuckles may be produced using the improved knuckle configurations disclosed and shown herein, including configurations that have one or more zones of weight reduction. In addition, lightweight knuckles are constructed from austempered ductile iron, austempered ductile iron alloy, austempered steel, and/or austempered steel alloy, in accordance with the invention, to provide knuckles that are lighter in weight than prior knuckles yet possesses suitable strength, yield and elongation properties that meet or exceed AAR testing and standards requirements set forth by the American Association of Railroads (AAR) in AAR Manual of Standards and Recommended Practices, and in Rules of the AAR Office Manual, the compete contents of which are herein incorporated by reference. The lightweight knuckles of the invention may be used in conjunction with couplers, including lightweight couplers, to further provide a lightweight solution to coupling rail cars.

A significant benefit of the present invention is that current proven knuckle designs and coring can be utilized to still provide a knuckle that is lighter, stronger and also has improved resistance to fatigue. According to some embodiments, the knuckles of the present invention may be constructed from austempered metal to significantly improve the fatigue resistance and/or strength if needed. In addition, due to the increased strength of the material, such as, for example, when the knuckle is constructed from austempered metal (e.g., such as, for example, austempered ductile iron), the coring configurations shown and described herein may be used to provide a knuckle that may be lighter in weight than prior knuckles and which also possess similar or increased resistance to fatigue (including in comparison to prior knuckles that are heavier in weight). The exemplary embodiments shown and described herein illustrate preferred coring for a knuckle having improved strength and resistance to fatigue, as well as a knuckle that is lighter in weight than traditional prior knuckles. Other knuckle embodiments disclosed herein provide a knuckle configuration that is similar to prior knuckle configurations, but is constructed from an austempered metal (preferably austempered ductile iron or austempered steel) to provide an improved strength to weight ratio as well as improved strength properties. Still other embodiments provide both coring and rib configurations to reduce mass, and compose the knuckle from an austempered metal (preferably austempered ductile iron or austempered steel), to improve or maintain fatigue resistance while maintaining the strength of the knuckle (e.g., a strength to weight ratio, as well as similar to improved fatigue resistance).

The knuckles constructed in accordance with the invention meet or exceed the standards set forth by the American Association of Railroads (AAR) in AAR Manual of Standards and Recommended Practices—Castings—Specifications M-216 and M-211, the compete contents of which is herein incorporated by reference. Knuckles constructed according to the present invention, including the embodiments shown and described herein, may withstand a minimum ultimate tension of 650,000 lbs in a static tension test, pursuant to AAR standard M-211. In addition, the knuckles of the present invention and including the embodiments shown and described herein meet or exceed the standard for fatigue life, under cycling loads, set forth in AAR standard M-216. Generally, the M-216 test involves the application by an approved machine of a draft or tensile load to a knuckle through an AAR approved standard production coupler body. The test input loads are sinusoidal and are applied in a series of segments having a minimum and a maximum load range. The testing segments are set forth and described in the AAR M-216 standard. The testing segments are repeated sequentially until failure occurs. In order for a knuckle to meet the M-216 standard, a specified lot of about 25 knuckles are provided for testing, of which four knuckles are selected and tested. The knuckles must exhibit an average life of at least 600,000 cycles, and no individual knuckle may exhibit a life below 400,000 cycles. Knuckles constructed in accordance with the present invention meet or exceed the M-216 standard, and each knuckle may exhibit a life of at least over 400,000 cycles and an average life of at least 600,000 cycles.

Although reference has been made to standard AAR knuckles, knuckles may be constructed according to the present invention with configurations that are significantly different than the current standard AAR knuckles, yet the knuckles may operate in the same manner as, and/or with compatibility to connect with, a standard knuckle. In addition, the embodiments also may include ribs provided for strengthening areas or zones of the knuckle, which, according to preferred embodiments, may be done in conjunction with coring. The ribs may be provided in alternate configurations to those shown and described herein. Although embodiments of the present lightweight fatigue-resistant knuckle may be constructed to resemble prior knuckle geometries, including, but not limited to, prior exterior knuckle geometries, the lightweight knuckles according to the invention, alternately, may be constructed to have geometries that are different than the prior knuckles, but which also are compatible with coupling and usage of the prior knuckles, so that the current knuckle may provide a lightweight knuckle alternative that may be used in place of prior knuckles, wherever the prior knuckles have been used or are called for.

Embodiments of the invention include knuckles that may have the same outside as a standard knuckle with a shell coring and, which also may have some ribbing structure such as is provided with the provisioning of ribs. Alternately, other embodiments of the knuckle according to the invention may have no inside coring and may be cored only from the outside, and may have an appearance that is completely different looking that a traditional standard knuckle. Other alternate embodiments may include inside coring and outside coring, which may have an appearance that looks like a standard knuckle, or may look completely different than a traditional standard knuckle. Other alternate embodiments may include inside coring similar to standard knuckles with the removal of outside geometry, which may have an appearance that looks similar to but not exactly like a standard knuckle. In addition, according to some embodiments, shot peening may be applied to the surface of any of the knuckles according to the invention.

It is intended that the foregoing detailed description be regarded as illustrative rather than limiting, and that it be understood that it is the following claims, including all equivalents, that are intended to define the spirit and scope of this invention.

What is claimed is:

1. A railway vehicle coupler knuckle comprising a top wall, a bottom wall, a rear tail portion having a locking face, an intermediate section including a throat wall and pin hole, and a forward portion including a nose surface and a curved pulling face merging with said throat wall, and a forward surface substantially uniformly spaced from said pulling face along the full length of the knuckle, the knuckle including a nose, wherein said nose has a cavity with a plurality of vertical walls being disposed between said top wall and said bottom wall and dividing said nose cavity into a plurality of subcavities.

2. The railway vehicle coupler knuckle of claim 1, wherein said knuckle is made from said austempered metal.

3. The railway vehicle coupler knuckle of claim 2, wherein said austempered metal is austempered ductile iron.

4. The railway vehicle coupler knuckle of claim 3, wherein said knuckle has one or more walls including said throat wall, and wherein said one or more walls has a wall thickness between 0.239 in and 1.7 in.

5. The railway vehicle coupler knuckle of claim 3, wherein said knuckle has one or more walls including said throat wall, and wherein said one or more walls has a wall thickness between 0.30 in and 1.05 in.

6. The railway vehicle coupler knuckle of claim 3, wherein said knuckle has one or more walls including said throat wall, and wherein said one or more walls has a wall thickness between 0.31 in and 0.87 in.

7. The knuckle of claim 6, wherein the throat wall, the nose wall, said plurality of vertical walls and said additional wall each has a thicknesses between 0.31 and 0.87 inches.

8. The knuckle of claim 3, wherein said ductile iron includes one or more metals selected from the group consisting of nickel, manganese, molybdenum, copper, magnesium.

9. The knuckle of claim 8, wherein said knuckle is sufficiently strong so as to withstand the standards for fatigue resistance pursuant to AAR standard M-216.

10. The railway vehicle coupler knuckle of claim 1, wherein said vertical walls are arranged so that an imaginary reference line drawn along at least some said vertical walls and extending in a direction away from the nose wall, and beyond the knuckle, intersect each other.

11. The railway vehicle coupler knuckle of claim 10, including a tail having a tail cavity, wherein said nose has a nose wall, wherein three of said plurality of vertical walls are arranged between the nose wall and extend from the nose wall to the throat, wherein said three vertical walls define three cavities in the nose, and wherein a pin hole cavity comprises a cavity formed by at least one of said three vertical walls and an additional vertical wall, said additional vertical wall being disposed on a side of the pin hole and having a first side that defines with the said at least one of the three vertical walls the pin hole cavity, said first side facing into the pin cavity, and wherein said additional wall has a second side that borders the tail cavity, said second side facing into the tail cavity.

12. The knuckle of claim 11, wherein said vertical walls and said additional walls are linear.

13. The knuckle of claim 10, wherein at least some of the imaginary reference lines intersect at a point within the knuckle cross-section.

14. The railway vehicle coupler knuckle of claim 1 wherein said vertical walls comprise ribs spanning between said top wall and said bottom wall, wherein said ribs connect said top wall with said bottom wall.

15. The railway vehicle coupler knuckle of claim 14, wherein at least some ribs are adjacently spaced apart, and wherein at least some adjacently spaced apart ribs define a pin cavity therebetween.

16. The railway vehicle coupler knuckle of claim 14, wherein said knuckle has a first side wall and a second side wall, wherein said ribs are adjacently spaced apart, and wherein said ribs have walls which are radially arranged, wherein said adjacently spaced apart ribs define a plurality of cavities cores therebetween, and wherein at least some of said cavities have a narrow cavity portion forming a vertex at the first side wall and a wide cavity portion bordered by said nose wall.

17. The railway vehicle coupler knuckle of claim 1, wherein said knuckle has a first side wall, a second side wall and a pin cavity, wherein said pin hole comprises a first opening in said top wall and a second opening in said bottom wall, wherein a top flange is disposed at said first pin hole opening and is connected to said top wall, wherein a bottom flange is disposed at said second pin hole opening and is connected to said bottom wall, and wherein said pin openings open into said pin cavity, wherein said pin cavity is defined by at least two of said plurality of vertical walls to form pin cavity walls, wherein said pin cavity walls span from said first side wall to said second side wall, and wherein said pin cavity walls are spaced apart to form a narrow cavity portion on one side of said pin cavity and a wide cavity portion on the opposite side of said pin cavity.

18. The railway vehicle coupler knuckle of claim 17, wherein said vertical walls comprise ribs, and wherein each rib has a first end and a second end, and wherein each rib first end converges with one of said first side wall and said second side wall of said knuckle.

19. The railway vehicle coupler knuckle of claim 18, wherein said first side wall includes the throat wall and pulling face wall, and wherein each said rib first end converges at said first side wall.

20. The railway vehicle coupler knuckle of claim 18, wherein said first side wall includes the throat wall and pulling face wall, and wherein each said rib first end converges at said first side wall.

21. The railway vehicle coupler knuckle of claim 17, wherein said vertical walls comprise ribs, and wherein each rib has a first end and a second end, and wherein each rib first end converges at a hub located along said curved pulling face and said throat wall.

22. The railway vehicle coupler knuckle of claim 21, wherein said ribs are linear walls.

23. The railway vehicle coupler knuckle of claim 1, wherein said vertical walls comprise ribs, and wherein each rib has a first end and a second end, and wherein each rib first end converges at a hub located along said curved pulling face and said throat wall.

24. The railway vehicle coupler knuckle of claim 1, wherein said ribs have linear walls and are arranged to define a plurality of cavities in the nose of said knuckle.

25. The railway vehicle coupler knuckle of claim 1, wherein said top wall has a first portion thereof that is lower in height relative to a second portion of said top wall, wherein said bottom wall has a first portion thereof that is lower in height relative to a second portion of said bottom wall, wherein said pin hole has a first opening at said bottom wall lower height portion and a second opening at said top wall lower height portion, the knuckle including a pin hole core defined by two vertical walls that span between said bottom wall lower height portion and said top wall lower height portion.

26. The railway vehicle coupler knuckle of claim 1, wherein said austempered metal is austempered alloy steel.

27. The railway vehicle coupler knuckle of claim 1, wherein said knuckle configuration is not an AAR standard knuckle configuration, and wherein said knuckle is compatibly configured to couple with AAR standard knuckles.

28. The knuckle of claim 1, wherein said ribs extend radially from the pulling face and throat wall.

29. The knuckle of claim 28, wherein said nose surface forms a front buff face, wherein said knuckle has an opposite sidewall on the side of the knuckle opposite that of said throat wall and said pulling face, wherein said ribs that extend radially from the pulling face and throat wall terminate at a front buff face or opposite sidewall.

30. The knuckle of claim 28, wherein at least three adjacently spaced ribs extend radially from a single location along the throat wall or pulling face.

31. The knuckle of claim 1, wherein said plurality of subcavities are wedge shaped.

32. A railway vehicle coupler knuckle constructed from an austempered metal; said knuckle comprising:

a) a casting that includes:

(i) a rear tail portion having a locking face, (ii) an intermediate section including a throat wall and pin hole, (iii) a forward portion including a nose surface and a curved pulling face merging with said throat wall, and (iv) a forward surface substantially uniformly spaced from said pulling face along the full length of the knuckle, (v) an upper pulling lug provided at said tail portion;

(vi) a lower pulling lug provided at said tail portion;

(vii) a pin core provided at said pin hole;

(viii) a plurality of spaced apart ribs defining vertices between two adjacent ribs, and being spaced apart to define a plurality of cavities, said pin cavity being one of said plurality of cavities;

(ix) wherein said plurality of spaced apart ribs are arranged in a configuration, wherein, when an imaginary line is drawn through the center of each said rib and extended beyond the throat wall or pulling face, at least a plurality of said imaginary lines drawn through the center of said ribs intersect, where said ribs are arranged such that any two points on said imaginary center line drawn through the center of a rib form a straight line.

33. The railway vehicle coupler knuckle of claim 32, wherein said pin cavity has a wide portion and a narrow portion, and wherein the vertex formed by two adjacent ribs that form the pin core is located at the narrow portion of the pin cavity.

34. The railway vehicle coupler knuckle of claim 33, wherein the pin cavity vertex is the narrowest portion of the pin cavity.

35. The knuckle of claim 32, wherein said at least two adjacent spaced apart ribs defining said pin hole cavity are linear ribs.

* * * * *